US008285164B2

(12) United States Patent
Imura et al.

(10) Patent No.: US 8,285,164 B2
(45) Date of Patent: Oct. 9, 2012

(54) DEVELOPING DEVICE, AND CONTROLLING METHOD THEREOF

(75) Inventors: Tomoyuki Imura, Toyohashi (JP); Kazuhiro Saito, Toyokawa (JP); Takuya Okada, Toyokawa (JP); Takuya Sasaki, Toyokawa (JP); Chikara Tsutsui, Nishinomiya (JP); Takayuki Takai, Anjou (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 74 days.

(21) Appl. No.: 12/876,557

(22) Filed: Sep. 7, 2010

(65) Prior Publication Data

US 2011/0058836 A1 Mar. 10, 2011

(30) Foreign Application Priority Data

Sep. 7, 2009 (JP) ..... 2009-205701

(51) Int. Cl.
*G03G 15/06* (2006.01)
*G03G 15/08* (2006.01)
*G03G 15/09* (2006.01)

(52) U.S. Cl. ..... 399/55; 399/270; 399/285

(58) Field of Classification Search ..... 399/55, 399/270, 285
See application file for complete search history.

(56) References Cited

U.S. PATENT DOCUMENTS 4,565,438 A * 1/1986 Folkins ..... 399/55
4,885,223 A 12/1989 Enoki et al.
5,617,190 A * 4/1997 Takenaka et al. ..... 399/159
5,625,441 A * 4/1997 Sugiyama et al. ..... 399/272
5,832,350 A * 11/1998 Kumasaka et al. ..... 399/282
5,991,587 A * 11/1999 Kikuchi ..... 399/282
7,917,046 B2 3/2011 Kubo
2003/0185598 A1* 10/2003 Folkins et al. ..... 399/266
2004/0022549 A1 2/2004 Ozawa et al.
2004/0101324 A1* 5/2004 Kawano ..... 399/55
2005/0158061 A1* 7/2005 Do ..... 399/44

(Continued)

FOREIGN PATENT DOCUMENTS

JP 63-103279 A 5/1988

(Continued)

OTHER PUBLICATIONS

Office Action (Decision to Grant a Patent) dated Aug. 9, 2011, issued in the corresponding Japanese Patent Application No. 2009-205699, and an English Translation thereof.

(Continued)

*Primary Examiner* — Walter L Lindsay, Jr.
*Assistant Examiner* — David Bolduc
(74) *Attorney, Agent, or Firm* — Buchanan Ingersoll & Rooney PC

(57) ABSTRACT

A developing device is provided with a developer transporting member for transporting a developer containing a toner and a carrier; a toner transporting member opposite to the developer transporting member and opposite to an electrostatic latent image carrying member; a first electric field forming device, which is composed of a power source for the developer transporting member and a power source for the toner transporting member, for shifting the toner in the developer held onto the developer transporting member to the toner transporting member; and a second electric field forming device for shifting the toner held onto the toner transporting member to an electrostatic latent image on the carrying member. Operation of the first electric field forming device is controlled based on an electric current flowing in the developer transporting member power source, which is detected by a detecting block.

8 Claims, 6 Drawing Sheets

U.S. PATENT DOCUMENTS

| | | | | |
|---|---|---|---|---|
| 2006/0222415 | A1* | 10/2006 | Hirobe | 399/265 |
| 2008/0181675 | A1* | 7/2008 | Fujishima et al. | 399/267 |
| 2008/0206661 | A1* | 8/2008 | Fujishima et al. | 430/48 |
| 2008/0226350 | A1* | 9/2008 | Goto et al. | 399/240 |
| 2008/0232859 | A1* | 9/2008 | Sakata et al. | 399/270 |
| 2008/0232860 | A1* | 9/2008 | Sakata et al. | 399/270 |
| 2008/0232862 | A1* | 9/2008 | Fujishima et al. | 399/285 |
| 2008/0292365 | A1* | 11/2008 | Fujishima et al. | 399/285 |
| 2009/0003891 | A1* | 1/2009 | Fujishima et al. | 399/284 |
| 2009/0067890 | A1* | 3/2009 | Maeyama et al. | 399/273 |
| 2009/0245886 | A1* | 10/2009 | Sakata | 399/270 |
| 2011/0058835 | A1 | 3/2011 | Imura et al. | |

FOREIGN PATENT DOCUMENTS

| | | | |
|---|---|---|---|
| JP | 6-214451 | A | 8/1994 |
| JP | 2003-287952 | A | 10/2003 |
| JP | 2005-078015 | A | 3/2005 |
| JP | 2005-316083 | A | 11/2005 |
| JP | 2007-163602 | A | 6/2007 |
| JP | 2008-287036 | A | 11/2008 |
| JP | 2009-008959 | A | 1/2009 |
| JP | 2009-086009 | A | 4/2009 |
| JP | 2011-059162 | A | 3/2011 |

OTHER PUBLICATIONS

Decision to Grant a Patent dated May 17, 2011, issued in corresponding Japanese Patent Application No. 2009-205701, and English language translation of the Decision.

* cited by examiner $$\text{PLUS DUTY RATIO} = \frac{t1}{t1+t2} \times 100\ [\%]$$

DEVELOPING DEVICE, AND CONTROLLING METHOD THEREOF

CROSS-REFERENCE TO RELATED APPLICATION

This application is based on Japanese Patent Application No. 2009-205701 filed in Japan, the content of which is incorporated herein by reference.

BACKGROUND OF THE INVENTION

1. Field of the Invention

The present invention relates to a developing device used in an image forming apparatus in an electrophotographic manner, such as a copying machine, a printer, a facsimile, or a multifunctional machine wherein two or more thereof are combined with each other; and a controlling method thereof.

2. Description of the Related Art

Regarding a developing device used in an image forming apparatus in an electrophotographic manner, hitherto, as a developing manner of developing an electrostatic latent image formed on an electrostatic latent image carrying member, the following have been known: a one-component developing manner in which only a toner is used as a main component of a developer (or developing agent), and a two-component developing manner in which a toner and a carrier are used as main components of a developer.

According to the one-component developing manner, generally, a toner is passed through a regulating region between a developing roller and a regulating plate arranged to be pushed onto the developing roller, thereby making it possible to cause the toner to undergo frictional electrification and further cause a toner thin layer having a desired thickness to be held onto the outer circumferential surface of the developing roller; therefore, this manner is advantageous for making the structure of the developing device used in the manner simple and small in size, and decreasing costs. However, in the one-component developing manner, the toner receives intense stress in the regulating region so that a deterioration in the toner is promoted. Thus, the charge amount of the toner is easily lowered with the passage of time. Moreover, the surface of the regulating plate or the surface of the developing roller is contaminated by the toner or some other external additive, so that the performance of giving electric charges onto the toner lowers. Thus, fogging or other problems are caused. As a result, the lifespan of the developing device becomes relatively short.

Additionally, in the one-component developing manner, the gap length of a developing spatial region formed between the developing roller and an electrostatic latent image carrying member opposite to this roller is varied with the passage of time so that density unevenness may be generated in obtained images. Against this, for example, Japanese Unexamined Patent Publication No. 2005-78015 discloses that in the one-component developing manner, the direct voltage value or alternating voltage value of a developing bias voltage to be applied is controlled on the basis of a value measured by an impedance measuring device for measuring an impedance of a developing spatial region and a result detected by a leakage detecting device for detecting a leakage through a leakage current flowing in the developing spatial region, whereby unevenness in the density of images is restrained.

In the meantime, according to the two-component developing manner, a toner is electrified by frictional contact between the toner and a carrier for the toner, the contact being made by mixing and stirring of the two components. Thus, stress that the toner receives is small. This matter is advantageous against a deterioration in the toner. The carrier as a material for giving electric charges to the toner is larger in surface area than particles of the toner; therefore, the carrier is relatively strong against contamination with the toner or other external additives. This is advantageous for making the lifespan of the developer longer. However, in the two-component developing manner also, the carrier is gradually contaminated with the toner or the other external additives after the developer is used over a long term. As a result, the charge amount of the toner falls so that fogging or other problems may be caused.

As a developing manner for overcoming the fall in the toner charge amount, the fogging, and other problems in the one-component and two-component developing manners, the so-called hybrid developing manner is suggested, the manner including: preparing a two-component developer composed of a toner and a carrier; electrifying the toner by frictional contact between the toner and the carrier; holding this developer made into a magnetic brush state on a transporting roller including therein a magnetic pole body while transporting the developer into a region opposite to a developing roller by the rotation of the transporting roller; supplying the developing roller with only the toner from the developer held onto the transporting roller by the effect of an electric field formed in this region, thereby forming a toner layer on the developing roller; transporting this toner layer to a region opposite to an electrostatic latent image carrying member by the rotation of the developing roller; and making use of the effect of an electric field formed in this opposite region to fly the toner held onto the developing roller onto an electrostatic latent image formed on the electrostatic latent image carrying member, thereby developing the latent image.

According to the hybrid developing manner, the electrification of the toner is attained by the frictional contact between the components of the two-component developer; thus, a deterioration in the toner is restrained, and a sufficient toner charge amount can be certainly kept. Moreover, the supply of the toner from the transporting roller to the developing roller is attained by the electric field; thus, no toner electrified into a reverse polarity is supplied to the developing roller. Accordingly, no toner adheres onto a non-image area on the electrostatic latent image carrying member, so that the generation of fogging is prevented. The adhesion of the carrier onto the electrostatic latent image carrying member is also prevented since only the toner is supplied to the developing roller.

Incidentally, in a case where, in a developing device in the hybrid developing manner, a new toner is supplied from a transporting roller to a developing roller and used for a development and subsequently a fraction of the toner that remains on the developing roller is collected onto the transporting roller, an image memory or a leakage may be generated when the gap length of an opposite spatial region formed between the transporting roller and the developing roller is varied.

When the gap length of the opposite spatial region, which is formed between the transporting roller and the developing roller, becomes larger than a predetermined value in the developing device of the hybrid developing manner, it may become insufficient to collect the toner fraction remaining on the developing roller onto the transporting roller after the development. Thus, an image memory may be caused. On the other hand, when the gap length between the transporting roller and the developing roller becomes smaller than a predetermined value, a leakage may be generated therebetween.

SUMMARY OF THE INVENTION

Thus, a main object of this invention is to provide a developing device in a hybrid developing manner using a two-component developer containing a toner and a carrier in which, even when the length of a gap between a transporting roller, and a developing roller is varied, the generation of an image memory or leakage due to the gap variation therebetween can be restrained so that a stable development can be attained.

In order to achieve the above object, the invention provides a first aspect of a developing device, including: a developer transporting member that is rotatably driven, and transports a developer containing a toner and a carrier while the member holds, on an outer circumferential surface thereof, the developer, a toner transporting member that is rotatably driven, and is opposite to the developer transporting member and opposite to an electrostatic latent image carrying member so as to transport the toner, a first electric field forming device that includes a power source for the developer transporting member connected to the developer transporting member, and a power source for the toner transporting member connected to the toner transporting member, forms a predetermined electric field between the developer transporting member and the toner transporting member, and shifts the toner in the developer held onto the developer transporting member to the toner transporting member, and a second electric field forming device that includes the toner transporting member power source connected to the toner transporting member, forms a predetermined electric field between the toner transporting member and the electrostatic latent image carrying member, and shifts the toner held onto the toner transporting member onto an electrostatic latent image on the electrostatic latent image carrying member, the developer being used to develop the electrostatic latent image on the electrostatic latent image carrying member, and after the development a fraction of the toner which remains on the toner transporting member being collected to the developer transporting member, the developing device further including: a detecting block that detects a current flowing in the developer transporting member power source, and an electric field controlling device that controls operation of the first electric field forming device based on the current flowing in the developer transporting member power source, the current being detected by the detecting block.

Moreover, the invention provides a second aspect of a developing device, including: a developer transporting member that is rotatably driven, and transports a developer containing a toner and a carrier while the member holds, on an outer circumferential surface thereof, the developer, a first toner transporting member that is rotatably driven, and is opposite to the developer transporting member to interpose a first spatial region between the first toner transporting member and the developer transporting member and opposite to an electrostatic latent image carrying member to interpose a second spatial region between the first toner transporting member and the carrying member, so as to transport the toner, a second toner transporting member that is rotatably driven, and is opposite to the developer transporting member to interpose a third spatial region between the second toner transporting member and the developer transporting member and opposite to the electrostatic latent image carrying member to interpose a fourth spatial region between the second toner transporting member and the carrying member, so as to transport the toner, a first electric field forming device that includes a power source for the developer transporting member connected to the developer transporting member, and a power source for the first toner transporting member connected to the first toner transporting member, forms a first electric field between the developer transporting member and the first toner transporting member, and shifts the toner in the developer held onto the developer transporting member to the first toner transporting member, a second electric field forming device that includes the first toner transporting member power source connected to the first toner transporting member, forms a second electric field between the first toner transporting member and the electrostatic latent image carrying member, and shifts the toner held onto the first toner transporting member to an electrostatic latent image on the electrostatic latent image carrying member, a third electric field forming device that includes the developer transporting member power source connected to the developer transporting member and a power source for the second toner transporting member connected to the second toner transporting member, forms a third electric field between the developer transporting member and the second toner transporting member, and shifts the toner in the developer held onto the developer transporting member to the second toner transporting member, and a fourth electric field forming device that includes the second toner transporting member power source connected to the second toner transporting member, forms a fourth electric field between the second toner transporting member and the electrostatic latent image carrying member, and shifts the toner held onto the second toner transporting member to the electrostatic latent image on the electrostatic latent image carrying member, the developer being used to develop the electrostatic latent image on the electrostatic latent image carrying member, and after the development fractions of the toner which remain on the first and second toner transporting members, respectively, are collected to the developer transporting member, the developing device further including: a detecting block that detects a current flowing in the developer transporting member power source, and an electric field controlling device that controls each of operation of the first electric field forming device and that of the third electric field forming device based on a current flowing in the developer transporting member power source, the current being detected by the detecting block in a case of forming predetermined electric fields in the first and third spatial regions by the first and third electric field forming devices, respectively, and a current flowing in the developer transporting member power source, the current being detected by the detecting block in a case of forming predetermined electric fields different from the predetermined electric fields in the first and third spatial regions by the first and third electric field forming devices, respectively.

Further, the invention provides a first aspect of a method for controlling a developing device including: a developer transporting member that is rotatably driven and transports a developer containing a toner and a carrier while the member holds on an outer circumferential surface thereof the developer, a toner transporting member that is rotatably driven and is opposite to the developer transporting member and opposite to an electrostatic latent image carrying member so as to transport the toner, a first electric field forming device that includes a power source for the developer transporting member connected to the developer transporting member and a power source for the toner transporting member connected to the toner transporting member, forms a predetermined electric field between the developer transporting member and the toner transporting member, and shifts the toner in the developer held onto the developer transporting member to the toner transporting member, and a second electric field forming device that includes the toner transporting member power source connected to the toner transporting member, forms a predetermined electric field between the toner transporting member and the electrostatic latent image carrying member, and shifts the toner held onto the toner transporting member to an electrostatic latent image on the electrostatic latent image carrying member, the developer being used to develop the electrostatic latent image on the electrostatic latent image carrying member, and after the development a fraction of the toner which remains on the toner transporting member being collected to the developer transporting member, the method including the step of detecting a current flowing in the developer transporting member power source, and then controlling operation of the first electric field forming device based on the detected current flowing in the developer transporting member power source.

Furthermore, the invention provides a second aspect of a method for controlling a developing device including: a developer transporting member that is rotatably driven and transports a developer containing a toner and a carrier while the member holds on an outer circumferential surface thereof the developer, a first toner transporting member that is rotatably driven and is opposite to the developer transporting member to interpose a first spatial region between the first toner transporting member and the developer transporting member and opposite to an electrostatic latent image carrying member to interpose a second spatial region between the first toner transporting member and the carrying member, so as to transport the toner, a second toner transporting member that is rotatably driven and is opposite to the developer transporting member to interpose a third spatial region between the second toner transporting member and the developer transporting member and opposite to the electrostatic latent image carrying member to interpose a fourth spatial region between the second toner transporting member and the carrying member, so as to transport the toner, a first electric field forming device that includes a power source for the developer transporting member connected to the developer transporting member and a power source for the first toner transporting member connected to the first toner transporting member, forms a first electric field between the developer transporting member and the first toner transporting member, and shifts the toner in the developer held onto the developer transporting member to the first toner transporting member, a second electric field forming device that includes the first toner transporting member power source connected to the first toner transporting member, forms a second electric field between the first toner transporting member and the electrostatic latent image carrying member, and shifts the toner held onto the first toner transporting member onto an electrostatic latent image on the electrostatic latent image carrying member, a third electric field forming device that includes the developer transporting member power source connected to the developer transporting member and a power source for the second toner transporting member connected to the second toner transporting member, forms a third electric field between the developer transporting member and the second toner transporting member, and shifts the toner in the developer held onto the developer transporting member to the second toner transporting member, and a fourth electric field forming device that includes the second toner transporting member power source connected to the second toner transporting member, forms a fourth electric field between the second toner transporting member and the electrostatic latent image carrying member, and shifts the toner held onto the second toner transporting member to the electrostatic latent image on the electrostatic latent image carrying member, the developer being used to develop the electrostatic latent image on the electrostatic latent image carrying member, and after the development fractions of the toner which remain on the first and second toner transporting members, respectively, being collected to the developer transporting member, the method including the step of detecting a current flowing in the developer transporting member power source in a case of forming predetermined electric fields in the first and third spatial regions by the first and third electric field forming devices, respectively, and a current flowing in the developer transporting member power source in a case of forming predetermined electric fields different from the predetermined electric fields in the first and third spatial regions by the first and third electric field forming devices, respectively, and then controlling each of operation of the first electric field forming device and that of the third electric field forming device based on the detected current flowing in the developer transporting member power source in the case of forming the predetermined electric fields in the first and third spatial regions, respectively, and the detected current flowing in the developer transporting member power source in the case of forming the predetermined electric fields different from the predetermined electric fields in the first and third spatial regions, respectively.

DESCRIPTION OF THE PREFERRED EMBODIMENTS

With reference to the attached drawings, preferred embodiments of the invention will be described hereinafter. In the description, the words "upper, over, above or on", "lower, under, below or beneath", "left" and "right", any wording including one or more of these words, the word "clockwise", the word "counterclockwise", and words or wordings each meaning a specified side or direction may be used; however, the use thereof is for making the understanding of the invention described with reference to the drawings easy, and the invention should not be interpreted to be restricted by the meanings of these words.

Figure 1:
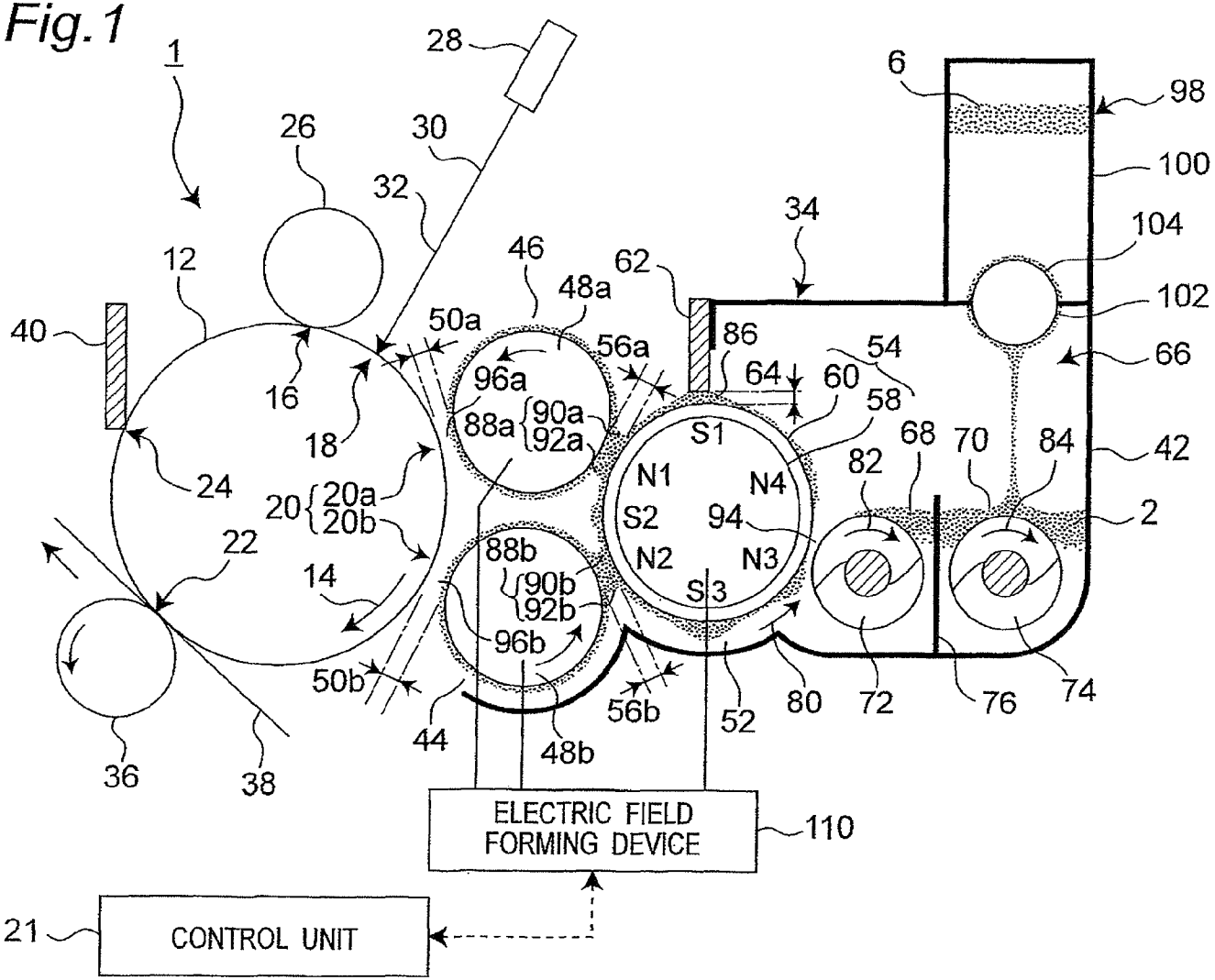
FIG. 1 is a view illustrating a schematic structure of an image forming apparatus including a developing device according to an embodiment of the invention.

FIG. 1 is a view illustrating a schematic structure of an image forming apparatus including a developing device according to an embodiment of the invention. The image forming apparatus may be any one of a copying machine, a printer, facsimile, and a multifunctional apparatus having two or more of functions of these machines or apparatus. An image forming apparatus 1 has a photoreceptor 12 as an electrostatic latent image carrying member on which an electrostatic latent image is to be carried. The photoreceptor 12 is in a barrel form. However, in the invention, the photoreceptor 12 is not limited to such a form. Thus, instead of the photoreceptor in the barrel form, a photoreceptor in an endless belt form may be used. The photoreceptor 12 is drivably connected to a motor not illustrated, and is rotatable in a direction represented by an arrow 14 on the basis of the driving of the motor. Around the photoreceptor 12, the following are successively arranged along the rotating direction of the photoreceptor 12 an electrifying (or charging) station 16, an exposing station 18, a developing station 20, a transferring station 22, and a cleaning station 24.

The electrifying station 16 has an electrifier 26 for electrifying a photoreceptor layer, which constitutes the outer circumferential surface of the photoreceptor 12, into a predetermined potential. The electrifier 26 is illustrated as a cylindrical roller; however, instead of this, an electrifier in any other form may be used, examples thereof including a rotary type or fixed type electrifier in a brush form, and an electrifier in a wire discharge manner. The exposing station 18 has a passage 32 for causing an image light ray 30, which is emitted from an exposing device 28 arranged near the photoreceptor 12 or apart from the photoreceptor 12, to advance onto the outer circumferential surface of the photoreceptor 12 electrified by the electrifier 26. An electrostatic latent image is formed on the outer circumferential surface of the photoreceptor 12 that has passed through the exposing station 18. The latent image is composed of a region where the image light ray is projected so that the potential is attenuated, and a region where the electrification potential is substantially maintained. In the present embodiment, the region where the potential is attenuated is an electrostatic latent image region, and the region where the electrification potential is substantially maintained is a non-electrostatic latent image region. The developing station 20 has a developing device 34 for visualizing and developing the electrostatic latent image by the use of a powdery developer. Details of the developing device 34 will be described later. The transferring station 22 has a transferring device 36 for transferring the visualized image formed on the outer circumferential surface of the photoreceptor 12 onto a sheet 38 as a recording medium 38. Although the transferring device 36 is illustrated as a cylindrical roller, a transferring device in any other form, such as a transferring device in a wire discharge manner, may be used. The cleaning station 24 has a cleaning device 40 for collecting, from the outer circumferential surface of the photoreceptor 12, a non-transferred fraction of the developer that remains on the outer circumferential surface of the photoreceptor 12 without being transferred onto the sheet 38 in the transferring station 22. The cleaning device 40 is shown as a plate-form blade; however, instead of this, a cleaning device in any other form, such as a rotary or fixed type cleaning device in a brush form, may be used.

When an image is formed in the image forming apparatus 1 having this structure, the photoreceptor 12 is clockwise rotated by the driving of the motor. At this time, an outer circumferential region of the photoreceptor 12 that passes through the electrifying station 16 is electrified into a predetermined potential by the electrifier 26. The electrified outer circumferential region of the photoreceptor 12 is exposed to the image light ray 30 in the exposing station 18, so that an electrostatic latent image is formed. The electrostatic latent image is transported into the developing station 20 to the accompaniment of the rotation of the photoreceptor 12, and visualized as a developer image in the station 20 by the developing device 34. In the embodiment, the developing station 20 includes a first developing station 20*a* and a second developing station 20*b*. Through the first and second developing stations 20*a* and 20*b*, the latent image is made into a visualized image as a developer image. The visualized developer image is transported to the transferring station 22 to the accompaniment of the rotation of the photoreceptor 12, and transferred onto the sheet 38 by the transferring device 36. The sheet 38, on which the developer image is transferred, is transported to a fixing station not illustrated, and the developer image is fixed onto the sheet 38. The outer circumferential region of the photoreceptor 12 that has passed through the transferring station 22 is transported to the cleaning station 24, and a fraction of the developer that remains on the outer circumferential surface of the photoreceptor 12 without being transferred onto the sheet 38 is collected.

The developing device 34 holds a two-component developer containing a nonmagnetic toner, which is made of first component particles, and a magnetic carrier, which is made of second component particles, and has a housing 42 holding various members that will be described below. In order to make the understanding of the invention easy by making FIG. 1 simple, the illustration of the housing 42 is partially deleted. In the developer used in the embodiment, the toner is electrified into negative polarity and the carrier is electrified into positive polarity by frictional contact of the two components with each other. However, the electrification properties (or charging characteristics) of the toner and the carrier used in the invention are not limited to those specified by the combination. Alternatively, the toner may be electrified into positive polarity and the carrier may be electrified into negative polarity by frictional contact of the two components with each other.

The housing 42 of the developing device 34 has an opening 44 made open toward the photoreceptor 12. In a space 46 formed near the opening 44 are arranged developing rollers 48*a* and 48*b*, which are toner transporting members. The first developing roller (first toner transporting member) 48*a* is positioned at the upstream side of the photoreceptor 12 in the rotating direction thereof, and the second developer roller (second toner transporting member) 48*b* is positioned at the downstream side of the photoreceptor 12 in the rotating direction thereof. Both of the first and second developing rollers 48*a* and 48*b* are cylindrical members. The first developing roller 48*a* is rotatably arranged in parallel to the photoreceptor 12 to interpose a predetermined first developing gap 50*a* between the roller 48*a* and the outer circumferential surface of the photoreceptor 12. The second developing roller 48*b* is also rotatably arranged in parallel to the photoreceptor 12 to interpose a predetermined second developing gap 50*b* between the roller 48*b* and the outer circumferential surface of the photoreceptor 12.

Each of the developing rollers 48*a* and 48*b* may be, for example, a conductive roller made of aluminum or some other metal, or a roller having an outer circumferential surface, which is the outermost layer region of the conductive roller, provided with a coating. The coating may be, for example, made of a resin such as polyester resin, polycarbonate resin, acrylic resin, polyethylene resin, polypropylene resin, urethane resin, polyamide resin, polyimide resin, polysulfone resin, polyetherketone resin, vinyl chloride resin, vinyl acetate resin, silicone resin or a fluorine-contained resin, or a coating made of a rubber such as silicone rubber, urethane rubber, nitrile rubber, natural rubber or isoprene rubber. However, the coating is not limited thereto. A conductant (or electric conductant) may be added into the coating or onto the surface of the coating. The conductant may be an electron conductant or an ion conductant. Examples of the electron conductant include ketjen black, acetylene black, furnace black, and other carbon black particles; metallic powder; and metal oxide particles. However, the electron conductant is not limited thereto. Examples of the ion conductant include cationic compounds such as quaternary ammonium salts;

amphoteric compounds; and other ionic polymer materials. However, the ion conductant is not limited thereto.

In the rear of the developing rollers 48*a* and 48*b*, another space 52 is formed. In the space 52, a transporting roller 54, which is a developer transporting member, is arranged in parallel to the first developing roller 48*a* to interpose a predetermined first supplying/collecting gap 56*a* between the roller 54 and the outer circumferential surface of the first developing roller 48*a*, as well as in parallel to the second developing roller 48*b* to interpose a predetermined second supplying/collecting gap 56*b* between the roller 54 and the outer circumferential surface of the second developing roller 48*b*. The transporting roller 54 has a magnet unit 58 fixed not to be rotatable, and a cylindrical sleeve 60 supported to be rotatable around the circumference of the magnet unit 58. Over the sleeve 60, a regulating plate 62, which is fixed to the housing 42 and is extended in parallel to the central axis of the sleeve 60, is arranged to interpose a predetermined regulating gap 64 between the plate 62 and the sleeve 60.

The magnet unit 58 has plural magnetic poles that are opposite to the inner surface of the sleeve 60 and are extended toward the central axis of the transporting roller 54. In the embodiment, the plural magnetic poles include a magnetic pole S1 opposite to an upper inner circumferential surface region of the sleeve 60 that is near the regulating plate 62, a magnetic pole N1 opposite to an upper left inner circumferential surface region of the sleeve 60 that is near the first supplying/collecting gap 56*a*, a magnetic pole S2 opposite to a left inner circumferential surface region of the sleeve 60, a magnetic pole N2 opposite to a lower left inner circumferential surface region of the sleeve 60 that is near the second supplying/collecting gap 56*b*, a magnetic pole S3 opposite to a lower inner circumferential surface region of the sleeve 60, and two adjacent magnetic poles N3 and N4 which have the same polarity and are opposite to a right inner circumferential surface region of the sleeve 60.

In the rear of the transporting roller 54, a developer agitating room 66 is formed. The agitating room 66 has a front room 68 formed near the transporting roller 54, and a rear room 70 apart from the transporting roller 54. In the front room 68, a front screw 72, which is a front agitating and transporting member for transporting the developer 2 from the front surface of the sheet on which FIG. 1 is drawn to the rear surface thereof while agitating the developer 2, is rotatably arranged. In the rear room 70, a rear screw 74, which is a rear agitating and transporting member for transporting the developer 2 from the rear surface of the sheet to the front surface thereof while agitating the developer 2, is rotatably arranged. As illustrated in FIG. 1, the front room 68 and the rear room 70 may be separated from each other by a partition wall 76 arranged therebetween. In this case, partition wall regions near both ends of each of the front room 68 and the rear room 70 are removed so that connection passages are formed. The developer reaching the downstream end of the front room 68 is sent through one of the connection passages to the rear room 70, and the developer reaching the downstream end of the rear room 70 is sent through the other connection passage to the front room 68.

Over the rear room 70 is arranged a toner replenishing unit 98. The toner replenishing unit 98 has a container 100 which holds a toner 6. An opening 102 is formed in the bottom of the container 100, and a replenishing roller 104 is arranged in the opening 102. The replenishing roller 104 is drivably connected to a motor not illustrated. The motor is driven by an output from a magnetic permeability sensor (not illustrated) as a measuring device for measuring the ratio (ratio by weight) of the toner 6 in the developer 2 held in the housing 42, so that the toner 6 is dropped and replenished into the rear room 70.

The transporting roller 54 and the developing rollers 48*a* and 48*b* are each connected electrically to an electric field forming device 110. The electric field forming device 110 is configured in such a manner that a predetermined electric field is formed between the transporting roller 54 and the first developing roller 48*a* as follows: inside a first supplying/collecting spatial region 88*a*, which is a spatial region between the transporting roller 54 and the first developing roller 48*a* opposite to each other, mainly in a first supplying spatial region 90*a*, which is a spatial region at the upstream side of the region 88*a* in the rotating direction of the transporting roller 54, the toner 6 in the developer 2 held onto the transporting roller 54 is shifted to the first developing roller 48*a*; and inside the first supplying/collecting spatial region 88*a*, mainly in a first collecting spatial region 92*a*, which is a spatial region at the downstream side of the region 88*a* in the rotating direction of the transporting roller 54, a fraction of the toner 6 that remains on the first developing roller 48*a* after a development is collected onto the transporting roller 54.

Moreover, the electric field forming device 110 is configured in such a manner that a predetermined electric field is formed between the transporting roller 54 and the second developing roller 48*b* as follows: inside a second supplying/collecting spatial region 88*b*, which is a spatial region between the transporting roller 54 and the second developing roller 48*b* opposite to each other, mainly in a second supplying spatial region 90*b*, which is a spatial region at the upstream side of the region 88*b* in the rotating direction of the transporting roller 54, the toner 6 in the developer 2 held onto the transporting roller 54 is shifted to the second developing roller 48*a*; and inside the second supplying/collecting spatial region 88*b*, mainly in a second collecting spatial region 92*b*, which is a spatial region at the downstream side of the region 88*b* in the rotating direction of the transporting roller 54, a fraction of the toner 6 that remains on the second developing roller 48*b* after a development is collected onto the transporting roller 54.

Figure 2:
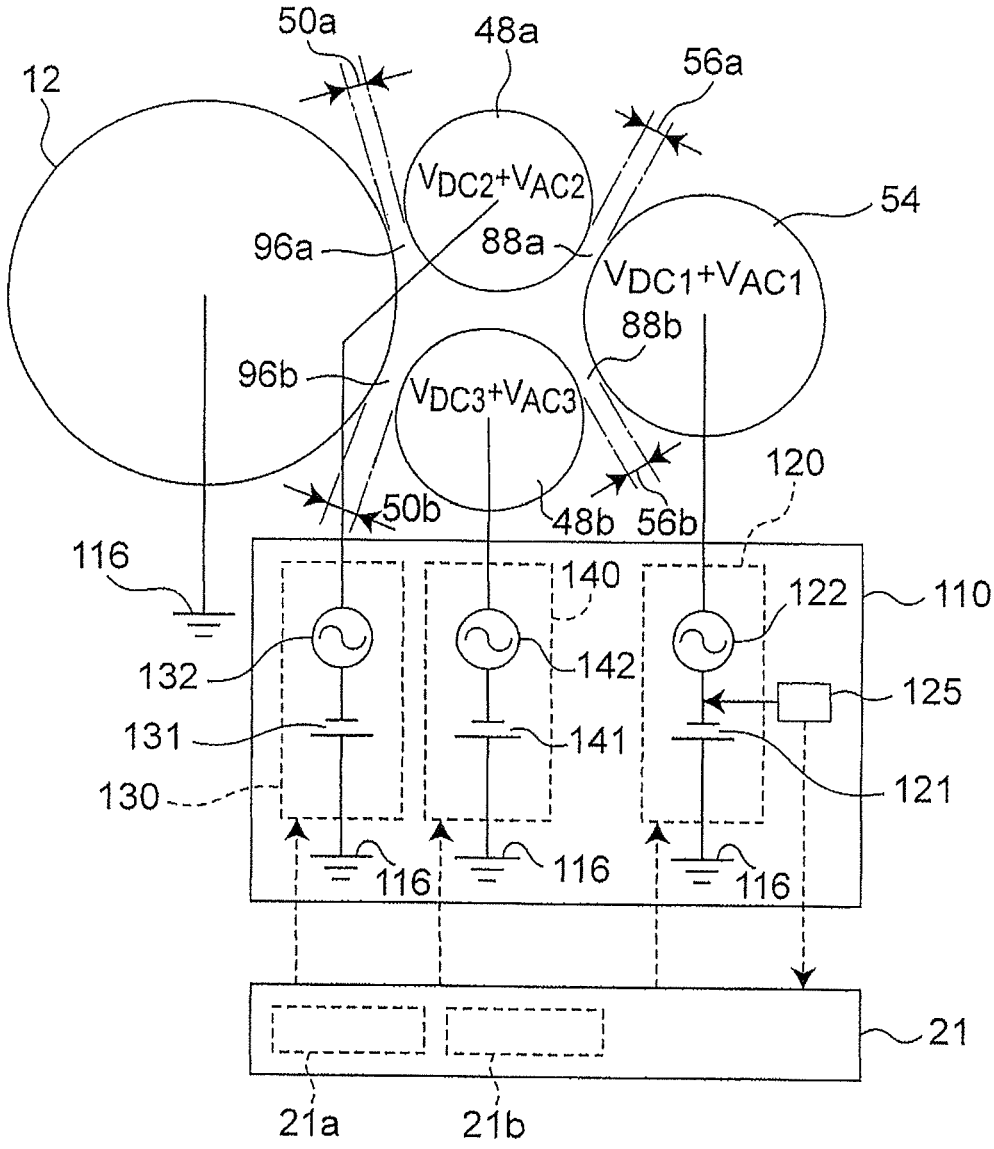
FIG. 2 is a view specifically illustrating an electric field forming device in the image forming apparatus.
Figure 3:
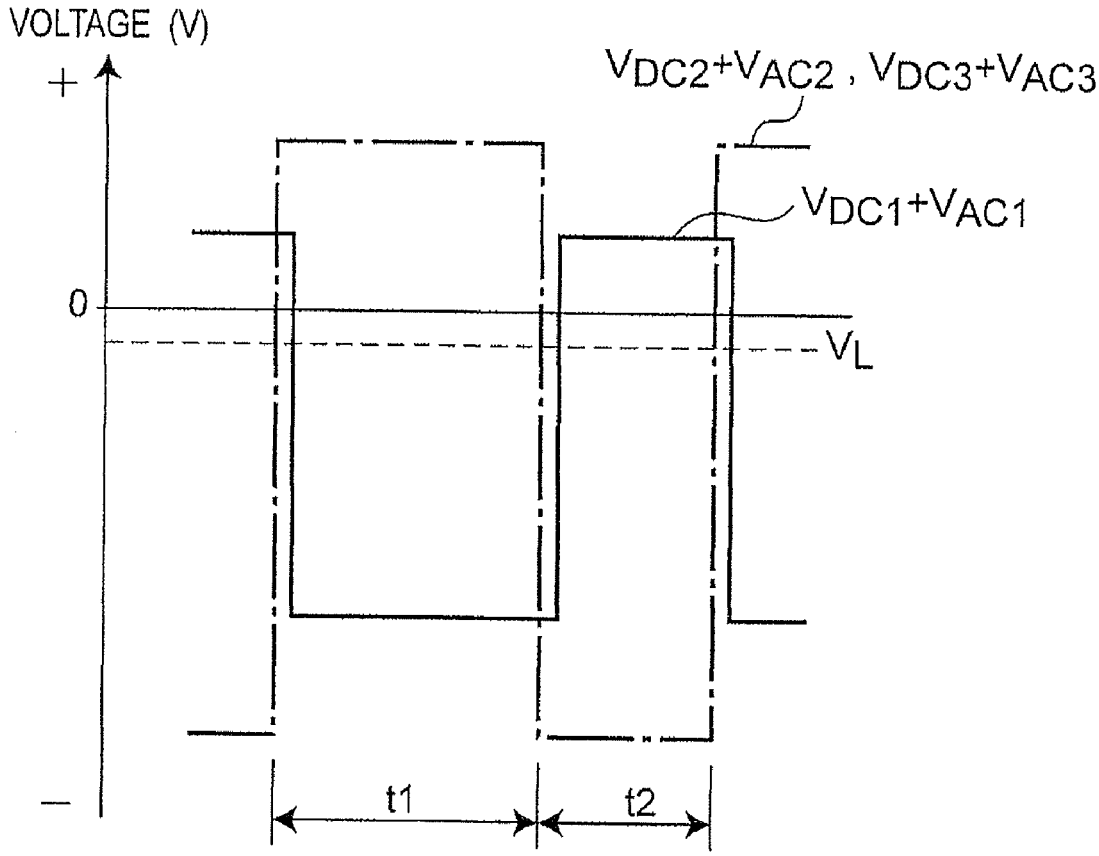
FIG. 3 is a chart showing a relationship between voltages supplied from the electric field forming device illustrated in FIG. 2 to a transporting roller and developing rollers.

FIG. 2 is a view specifically illustrating the electric field forming device 110 in the image forming apparatus 1, and FIG. 3 is a chart showing a relationship between voltages supplied from the electric field forming device 110 illustrated in FIG. 2 to the transporting roller 54 and the developing rollers 48*a* and 48*b*. The electric field forming device 110 illustrated in FIG. 2 has a first power source (developer transporting member power source) 120 connected to the transporting roller 54, a second power source (first toner transporting member power source) 130 connected to the first developing roller 48*a*, and a third power source (second toner transporting member power source) 140 connected to the second developing roller 48*b*.

The first power source 120 has a first DC power source 121 and a first AC power source 122 between the transporting roller 54 and a ground 116 so as to be connected in series to the roller 59 and the ground 116. The first DC power source 121 applies a first direct voltage $V_{DC1}$ (for example, −270 V) having a polarity identical to the electrified polarity of the toner 6 to the transporting roller 54, and the first AC power source 122 applies a first alternating voltage $V_{AC1}$ (for example, frequency: 3 kHz, amplitude $V_{P\text{-}P}$: 900 V, plus duty ratio: 40%, and minus duty ratio: 60%) to the transporting roller 54 and the ground 116 from therebetween.

The second power source 130 has a second DC power source 131 and a second AC power source 132 between the first developing roller 48*a* and the ground 116 so as to be connected in series to the roller 48*a* and the ground 116. The second DC power source 131 applies a second direct voltage $V_{DC2}$ (for example, −300 V) having a polarity identical to the electrified polarity of the toner 6 to the first developing roller 48*a*, and the second AC power source 132 applies a second alternating voltage $V_{AC2}$ (for example, frequency: 3 kHz, amplitude $V_{P-P}$:1,400 V, plus duty ratio: 60%, and minus duty ratio: 90%) to the developing roller 48*a* and the ground 116 from therebetween.

The third power source 140 has a third DC power source 141 and a third AC power source 142 between the second developing roller 48*b* and the ground 116 so as to be connected in series to the roller 48*b* and the ground 116. The third DC power source 141 applies a third direct voltage $V_{DC3}$ (for example, −300 V) having a polarity identical to the electrified polarity of the toner 6 to the second developing roller 48*b*, and the third AC power source 142 applies a third alternating voltage $V_{AC3}$ (for example, frequency: 3 kHz, amplitude $V_{P-P}$: 1,400 V, plus duty ratio: 60%, and minus duty ratio: 40%) to the second developing roller 48*b* and the ground 116 from therebetween. The voltage applied to the transporting roller 54 and the voltages applied to the developing rollers 48*a* and 48*b* are set to cause their phases to be deviated from each other. In FIG. 3, the voltage applied to the transporting roller 54 is slightly shifted from the voltages applied to the developing rollers 48*a* and 48*b* along the time axis direction (the transverse direction) to make FIG. 3 easy to understand. The voltage applied to the first developing roller 48*a* may be made different from that applied to the second developing roller 48*b*.

With regard to the first developing roller 48*a*, as illustrated in FIG. 3, in the case of applying a vibration voltage $V_{DC1}+V_{AC1}$ in a rectangular wave form obtained by superimposing the first alternating voltage $V_{AC1}$ onto the first direct voltage $V_{DC1}$ of −270 V to the transporting roller 54 and further applying a vibration voltage $V_{DC2}+V_{AC2}$ in a rectangular wave form obtained by superimposing the second alternating voltage $V_{AC2}$ onto the second direct voltage $V_{DC2}$ of −300 V to the first developing roller 48*a*, a vibration electric field (first electric field) is formed between the transporting roller 59 and the first developing roller 48*a*. In the supplying spatial region 90*a*, the toner 6 electrified into negative polarity receives the effect of the vibration electric field, so as to be electrically attracted from the transporting roller 54 to the first developing roller 48*a*. At this time, the carrier electrified into positive polarity is held onto the transporting roller 54 by the magnetic force of the fixed magnet unit 58 inside the transporting roller 59, so that the carrier is not supplied to the first developing roller 48*a*.

In a developing spatial region 96*a*, the negatively electrified toner held onto the first developing roller 48*a* receives the effect of a vibration electric field (second electric field) formed between the first developing roller 98*a*, to which the vibration voltage $V_{DC2}+V_{AC2}$ in the rectangular wave form is applied, and an electrostatic latent image region $V_L$ (for example, −80 V), so as to adhere onto the electrostatic latent image region. The first power source 120 and the second power source 130 constitute a first electric field forming device, and the second power source 130 constitutes a second electric field forming device.

With regard to the second developing roller 48*b* also, in the case of applying the vibration voltage $V_{DC1}+V_{AC1}$ in the rectangular wave form, which is obtained by superimposing the first alternating voltage $V_{AC1}$ onto the first direct voltage $V_{DC1}$ of −270 V, to the transporting roller 54 and further applying a vibration voltage $V_{DC3}+V_{AC3}$ in the rectangular wave form obtained by superimposing the third alternating voltage $V_{AC3}$ onto the third direct voltage $V_{DC3}$ of −300 V to the second developing roller 48*b*, a vibration electric field (third electric field) is formed between the transporting roller 54 and the second developing roller 48*b*. In the supplying spatial region 90*b*, the toner electrified into negative polarity receives the effect of the vibration electric field, so as to be electrically attracted from the transporting roller 54 to the second developing roller 48*b*. At this time, the carrier electrified into positive polarity is held onto the transporting roller 54 by the magnetic force of the fixed magnet unit 58 inside the transporting roller 54, so that the carrier is not supplied to the second developing roller 48*b*.

In a developing spatial region 96*b*, the negatively electrified toner held onto the second developing roller 48*b* receives the effect of a vibration electric field (fourth electric field) formed between the second developing roller 48*b*, to which the vibration voltage $V_{DC3}+V_{AC3}$ in the rectangular wave form is applied, and the electrostatic latent image region $V_L$ (for example, −80 V), so as to adhere onto the electrostatic latent image region. The first power source 120 and the third power source 140 constitute a third electric field forming device, and the third power source 140 constitutes a fourth electric field forming device.

In the developing device 34, a first detecting block 125 is set up for detecting a current flowing in the first power source 120 connected to the transporting roller 54. As will be detailed later, the detecting block 125 has, inside the first power source 120, a resistance between the DC power source 121 and the AC power source 122 so as to be connected in series to the DC power source 121 and the AC power source 122 and also has a monitor voltage through which a voltage in a predetermined position between the resistance and the first AC power source 122 is detected. From the voltage detected through the monitor voltage, the current flowing in the first power source 120 can be detected.

The detecting block 125 is connected to a control unit 21 for controlling synthetically operations of the constituents related to the image forming apparatus 1, for example, rotational drivings of the photoreceptor 12, the developing rollers 48*a* and 48*b* and the transporting roller 54, and operations of the electrifier 26, the exposing device 28, the developing device 34, the transferring device 36 and the electric field forming device 110. The control unit 21 is equipped with an electric field control unit 21*a* as an electric field controlling device for controlling operations of the first, second and third power sources 120, 130 and 140 on the basis of the current flowing in the first power source 120, which is detected by the detecting block 125. The control unit 21 is also equipped with a load capacity calculating unit 21*b* as a load capacity calculating device for calculating the load capacities of the spatial regions formed between the transporting roller 54 and the developing rollers 48*a* and 48*b*, respectively, on the basis of the current flowing in the first power source 120, which is detected by the first detecting block 125. Specifically, the electric field control unit 21*a* controls operations of the first, second and third power sources 120, 130 and 140 on the basis of the load capacities of the spatial regions formed between the transporting roller 54 and the developing rollers 48*a* and 48*b*, respectively, which is calculated by the load capacity calculating unit 21*b*. The control unit 21 is made mainly of, for example, a microcomputer.

The load capacities of the spatial regions formed between the transporting roller 54 and the developing rollers 48*a* and 48*b*, respectively, are described below.

Figure 4:
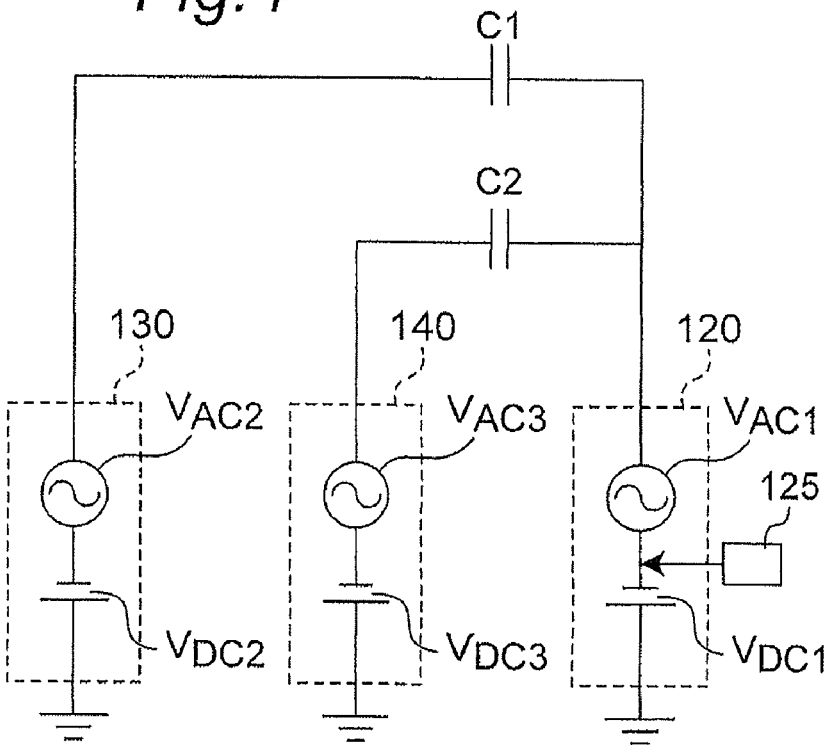
FIG. 4 is a diagram showing a circuit equivalent to a circuit composed of the transporting roller and the developing rollers.

FIG. 4 is a diagram showing a circuit equivalent to a circuit composed of the transporting roller 54 and the developing rollers 48*a* and 48*b*. In FIG. 4, the following case is illustrated as the equivalent circuit: the case of applying the vibration voltage $V_{DC1}+V_{AC1}$ obtained by superimposing the first alternating voltage $V_{AC1}$ onto the first direct voltage $V_{DC1}$ to the transporting roller 54, applying the vibration voltage $V_{DC2}+V_{AC2}$ obtained by superimposing the second alternating voltage $V_{AC2}$ onto the second direct voltage $V_{DC2}$ to the first developing roller 48*a*, which is arranged to interpose the first supplying/collecting gap 56*a* between the developing roller 48*a* and the transporting roller 54, and applying the vibration voltage $V_{DC3}+V_{AC3}$ obtained by superimposing the third alternating voltage $V_{AC3}$ onto the third direct voltage $V_{DC3}$ to the second developing roller 48*b*, which is arranged to interpose the second supplying/collecting gap 56*b* between the developing roller 48*b* and the transporting roller 54.

The equivalent circuit of the circuit composed of the transporting roller 54 and the developing rollers 48*a* and 48*b* is illustrated as a circuit in which the first power source 120, a first capacitor C1 and the second power source 130 are connected in series to each other, the capacitor C1 being composed of the transporting roller 54 and the first developing roller 48*a* opposite to each other so as to interpose the first supplying/collecting gap 56*a* therebetween, as well as the first power source 120, a second capacitor C2 and the third power source 140 are connected in series to each other, the second capacitor C2 being composed of the transporting roller 54 and the second developing roller 48*b* opposite to each other so as to interpose the second supplying/collecting gap 56*b* therebetween.

The load capacity C of each of the first capacitor C1 and the second capacitor C2 can be represented by the following equation:

$$C=\in\times S/d$$

wherein $\in$ represents the dielectric constant of the first capacitor C1 or C2, S represents the area thereof, and d represents the thickness thereof. In the embodiment, about the first capacitor C1, S represents the opposite area between the transporting roller 54 and the first developing roller 48*a* in the first supplying/collecting spatial region 88*a*, and d represents the length of the first supplying/collecting gap 56*a* in the first supplying/collecting spatial region 88*a*; and about the second capacitor C2, S represents the opposite area between the transporting roller 54 and the second developing roller 48*b* in the second supplying/collecting spatial region 88*b*, and d represents the length of the second supplying/collecting gap 56*b* in the second supplying/collecting spatial region 88*b*.

As shown by the above equation, the load capacities C of the first and second capacitors C1 and C2 are changed in accordance with the lengths of the supplying/collecting gaps 56*a* and 56*b*, respectively. As the supplying/collecting gaps 56*a* and 56*b* become larger, the load capacities become smaller. To the contrary, as the supplying/collecting gaps 56*a* and 56*b* become smaller, the load capacities become larger.

Accordingly, the load capacities of the above spatial regions 88*a* and 88*b* formed between the transporting roller 54 and the developing rollers 48*a* and 48*b*, respectively, mean the load capacities of the first capacitor C1 and the second capacitor C2, respectively, which are composed of the transporting roller 54 and the developing roller 48*a* and 48*b*, respectively. As the gaps 56*a* and 56*b* of the spatial regions 88*a* and 88*b* formed between the transporting roller 54 and the developing roller 48*a* and 48*b*, respectively, become larger, the load capacities become smaller. To the contrary, as the gaps 56*a* and 56*b* become smaller, the load capacities become larger.

The following will describe the operation of the developing device 34 having this structure. When an image is formed, the developing rollers 48*a* and 48*b* and the transporting roller 54 are counterclockwise rotated on the basis of the driving of the motor. The front screw 72 and the rear screw 74 are rotated in directions represented by arrows 82 and 84, respectively. In this way, the developer 2 contained in the developer agitating room 66 is agitated while being circularly transported between the front room 68 and the rear room 70. As a result, the toner 6 and the carrier contained in the developer 2 undergo fractional contact, so that they are electrified into polarities reverse to each other. In the embodiment, the carrier and the toner are electrified into positive polarity and negative polarity, respectively. The particles of the carrier are larger than those of the toner; thus, the toner particles electrified into negative polarity adhere to the peripheries of the carrier particles electrified into positive polarity mainly on the basis of electrically attractive force between the both particles.

The electrified developer 2 is supplied to the transporting roller 54 in the step in which the developer 2 is transported in the front room 68 by the front screw 72. Near the magnetic pole N4, the developer 2 supplied to the transporting roller 54 by the front screw 72 is held onto the transporting roller 54, specifically the outer circumferential surface of the sleeve 60, by magnetic force of the magnetic pole N4. The developer 2 held onto the sleeve 60 constitutes a magnetic brush along magnetic force lines formed by the magnetic unit 58, and is counterclockwise transported on the basis of the rotation of the sleeve 60. Regarding the developer 2 held onto the magnetic pole S1 in a regulating region 86, which is a spatial region opposite to the regulating plate 62, the amount thereof that passes through the regulating gap 64 is regulated into a predetermined amount by the regulating plate 62. The developer that has passed through the regulating gap 64 is transported into the spatial region 88*a* between the first developing roller 48*a* and the transporting roller 54 opposed to each other, the region 88*a* being opposite to the magnetic pole N1.

As described above, inside the supplying/collecting spatial region 88*a*, mainly in the spatial region 90*a* at the upstream side of the supplying/collecting spatial region 88*a* in the rotating direction of the sleeve 60, the toner 6 adhering to the carrier is electrically supplied to the developing roller 48*a* by the existence of the electric field formed between the developing roller 48*a* and the transporting roller 54, so that the toner 6 is shifted from the transporting roller 54 to the developing roller 48*a*.

The toner 6 held onto the developing roller 48*a* in the supplying spatial region 90*a* is counterclockwise transported to the accompaniment of the rotation of the developing roller 48*a*, and then adheres, in the developing spatial region 96*a*, onto an electrostatic latent image region formed on the outer circumferential surface of the photoreceptor 12. In the image forming apparatus 1, a negative predetermined potential $V_H$ (for example, −600 V) is applied to the outer circumferential surface of the photoreceptor 12 by the electrifier 26. The electrostatic latent image region, on which the image light ray 30 is projected by the exposing device 28, is attenuated into a predetermined potential $V_L$ (for example, −80 V) while the non-electrostatic latent image region on which the image light ray 30 is not projected by the exposing device 28 substantially keeps the electrification potential $V_H$. Accordingly, in the developing spatial region 96*a*, the toner 6 electrified into negative polarity receives the effect of the electric field formed between the photoreceptor 12 and the first developing roller 48*a* so as to adhere to the electrostatic latent image region, so that this electrostatic latent image is made into a visible image as a toner image.

In the meantime, a fraction of the toner 6 that remains on the developing roller 48*a* after the development, without being supplied for the development, is counterclockwise transported in accordance with the rotation of the developing roller 48*a*. Inside the supplying/collecting spatial region 88*a*, mainly in the spatial region 92*a* at the downstream side of the region 88*a* in the rotation direction of the sleeve 60, the fraction of the toner 6 is scratched away by the magnetic brush formed along the magnetic force lines of the magnetic pole N1, so as to be collected onto the transporting roller 54. The developer 2 containing the fraction of the toner 6 collected onto the transporting roller 54 is held by magnetic force of the magnetic unit 58, and passes through a spatial region opposite to the magnetic pole S2 to the accompaniment of the rotation of the transporting roller 54, so as to be transported to the spatial region 88*b* between the second developing roller 48*b* and the transporting roller 54 opposite to each other, the region 88*b* being opposite to the magnetic pole N2.

Substantially the same matter is applied to the supplying/collecting spatial region 88*b* as descried above. Specifically, inside the supplying/collecting spatial region 88*b*, mainly in the spatial region 90*b* at the upstream side of the region 88*b* in the rotating direction of the sleeve 60, the toner 6 adhering to the carrier is electrically supplied to the developing roller 48*b* by the existence of an electric field formed between the developing roller 48*b* and the transporting roller 54, so that the toner 6 is shifted from the transporting roller 54 to the developing roller 48*b*.

The toner 6 held onto the developing roller 48*b* in the supplying spatial region 90*b* is counterclockwise transported to the accompaniment of the rotation of the developing roller 48*b*, and then adheres, in the developing spatial region 96*b*, onto an electrostatic latent image region formed on the outer circumferential surface of the photoreceptor 12. As described above, in the image forming apparatus 1, the negative predetermined potential $V_H$ (for example, −600 V) is applied to the outer circumferential surface of the photoreceptor 12 by the electrifier 26. The electrostatic latent image region, on which the image light ray 30 is projected by the exposing device 28, is attenuated into the predetermined potential $V_L$ (for example, −80 V) while the non-electrostatic latent image region, on which the image light ray 30 is not projected by the exposing device 28, substantially keeps the electrification potential $V_H$. Accordingly, in the developing spatial region 96*b* also, the toner 6 electrified into negative polarity receives the effect of the electric field formed between the photoreceptor 12 and the developing roller 48*b* so as to adhere to the electrostatic latent image region. This electrostatic latent image is made into a visible image as a toner image.

In the meantime, a fraction of the toner 6 that remains on the developing roller 48*b* after the development, without being supplied for the development, is counterclockwise transported in accordance with the rotation of the developing roller 48*b*. Inside the supplying/collecting spatial region 88*b*, mainly in the spatial region 92*b* at the downstream side of the region 88*b* in the rotation direction of the sleeve 60, the fraction of the toner 6 is scratched away by the magnetic brush formed along the magnetic force lines of the magnetic pole N2, so as to be collected onto the transporting roller 54. The developer 2 containing the fraction of the toner 6 collected onto the transporting roller 54 is held by magnetic force of the magnetic unit 58. When the developer 2 passes through a spatial region opposite to the magnetic pole S3 to the accompaniment of the rotation of the transporting roller 54 to reach a releasing region 94, which is a spatial region formed by the magnetic poles N3 and N4 opposing to each other, the developer 2 is released from the outer circumferential surface of the transporting roller 54 to the front room 68 by a repulsive magnetic field formed by the magnetic poles N3 and N4, so as to be incorporated into the developer 2 that is being transported in the front room 68.

The following will describe specific materials of the toner and the carrier, which constitute the developer 2, and those of other particles contained in the developer 2.

The toner may be a known one that has been conventionally used in image forming, apparatuses. The toner particle diameter is, for example, from about 3 to 15 μm. The toner may be one in which a colorant is incorporated into a binder resin, one containing a charge control agent or a releasing agent, or one having a surface for holding an additive. The toner may be produced by, for example, a pulverizing method, an emulsion polymerization method, or a suspension polymerization method, or any other known method.

The carrier may be a known one that has been conventionally and generally used. The carrier may be either of a binder type or of a coat type. The carrier particle diameter, which is not limited, is preferably from about 15 to 100 μm.

The binder type carrier is one in which fine magnetic-material particles are dispersed in a binder resin, and may be one having a surface containing fine particles or a coating layer chargeable into positive or negative polarity. The polarity of the binder type carrier and other electrification properties thereof may be controlled by the material of the binder resin, the kind of the chargeable fine particles or the surface coating layer.

Examples of the binder resin used in the binder type carrier include vinyl resins, a typical example of which is polystyrene resin, polyester resins, nylon resins, polyolefin resins, and other thermoplastic resins; and phenol resin and other thermosetting resins.

The fine magnetic-material particles of the binder type carrier may be magnetite particles, spinel ferrite particles such as gamma iron oxide particles, spinel ferrite particles containing one or more of metals other than iron (such as Mn, Ni, Mg and Cu), barium ferrite particles, other magnetoplumbite type ferrite particles, or iron or alloy particles having surfaces containing iron oxide. The carrier may have a granular form, a spherical form, a needle form, or any other form. When a particularly high magnetization is required, it is preferred to use iron based ferromagnetic fine particles. Considering chemical stability, it is preferred to use ferromagnetic fine particles made of magnetite, spinel ferrite containing gamma iron oxide, barium ferrite, or any other magnetoplumbite type ferrite. By selecting the kind of the ferromagnetic fine particles or the content by percentage thereof appropriately, a magnetic resin carrier having a desired magnetization can be obtained. It is proper to add the fine magnetic-material particles to the magnetic resin carrier in a proportion of 50 to 90% by weight.

The material of the surface coating layer of the binder type carrier may be silicone resin, acrylic resin, epoxy resin, fluorine-contained resin, or the like. When the carrier surface is coated with the resin and then the resin is cured to form a coating layer, the charge-giving capability of the carrier can be improved.

The fixation or bonding of the chargeable fine particles or conductive fine particles onto the surface of the binder type carrier is attained, for example, by mixing a magnetic resin carrier as the binder type carrier with the fine particles into a homogeneous state to cause the fine particles to adhere onto the surface of the magnetic resin carrier, and then giving mechanical or thermal impact force thereto, thereby sinking the fine particles into the magnetic resin carrier. In this case, the fixation is not attained in such a manner that the fine particles are completely embedded in the magnetic resin carrier, but is attained in such a manner that the fine particles are partially projected from the magnetic resin carrier surface. The chargeable fine particles may be made of an organic or inorganic insulating material. Specific examples of the organic insulating material include fine particles of polystyrene, styrene based copolymer, acrylic resin, various acrylic copolymers, nylon, polyethylene, polypropylene, and fluorine-contained resin; and crosslinked materials thereof. The charge-giving capability and the electrified polarity can be adjusted by the material of the chargeable fine particles, a catalyst for polymerization for yielding the particles, surface treatment applied to the particles, or the like. Specific examples of the inorganic insulating material include silica, titanium dioxide, and other inorganic materials chargeable into negative polarity; and strontium titanate, alumina, and other inorganic materials chargeable into positive polarity.

The coat type carrier is one in which carrier core particles made of a magnetic material are coated with a resin. In the same manner as in the case of the binder type carrier, chargeable fine particles, which can be charged into positive polarity or negative polarity, can be fixed and bonded onto the carrier surface. The polarity of the coat type carrier or other electrification properties thereof can be adjusted by the kind of the surface coating layer or the chargeable fine particles. The coating resin may be identical to the binder resin of the binder type carrier.

It is sufficient for the blend ratio between the toner and the carrier to be adjusted to give a desired charge amount of the toner. The proportion of the toner is preferably from 3 to 50% by weight of the total of the toner and the carrier, more preferably from 6 to 30% by weight thereof.

The binder resin used in the toner is not limited, and examples thereof include styrene based resins (homopolymers or copolymers containing styrene or a substituted styrene compound), polyester resins, epoxy resins, vinyl chloride resins, phenol resins, polyethylene resins, polypropylene resins, polyurethane resins, silicone resins, and any resin in which two or more of these resins are mixed at any ratio. The binder resin preferably has a softening temperature of about 80 to 160° C., and a glass transition temperature of about 50 to 75° C.

The colorant used for the toner may be a known material, such as carbon black, aniline black, activated carbon, magnetite, benzine yellow, permanent yellow, naphthol yellow, phthalocyanine blue, fast sky blue, ultramarine blue, rose bengal, or lake red. In general, the addition amount of the colorant is preferably from 2 to 20 parts by weight for 100 parts by weight of the binder resin.

The charge control agent used for the toner may be a material that has been conventionally used as a charge control agent. Specific examples thereof for the toner electrified into positive polarity include nigrosin dyes, quaternary ammonium salt based compounds, triphenylmethane based compounds, imidazole based compounds, and polyamine resins. Specific examples thereof for the toner electrified into negative polarity include azo dyes each containing a metal such as Cr, Co, Al or Fe, salicylic acid metal compounds, alkylsalicylic acid metal compounds, and calixarene compounds. The charge control agent is used preferably in a proportion of 0.1 to 10 parts by weight for 100 parts by weight of the binder resin.

The releasing agent used for the toner may be a material that has been conventionally used as a releasing agent. Examples of the releasing agent include polyethylene, polypropylene, carnauba wax, Sasol wax, and any mixture in which two or more thereof are appropriately combined with each other. The releasing agent is used preferably in a proportion of 0.1 to 10 parts by weight for 100 parts by weight of the binder resin.

Additionally, a fluidizer for promoting the fluidization of the developer may be added to the toner. The fluidizer may be, for example, inorganic particles made of silica, titanium oxide or aluminum oxide. The fluidizer is in particular preferably a material made hydrophobic with a silane coupling agent, a titanium coupling agent, a silicone oil, or the like. The fluidizer is added preferably in a proportion of 0.1 to 5 parts by weight for 100 parts by weight of the toner. The number-average primary particle diameter of these additives is preferably from 9 to 100 nm.

In a case where in the developing device 34 in the hybrid developing manner also, which has the above-mentioned structure, the lengths of the supplying/collecting gaps 56*a* and 56*b* of the supplying/collecting spatial regions 88*a* and 88*b* formed between the transporting roller 54 and the developing rollers 48*a* and 48*b*, respectively, are varied, an image memory or leakage caused by the gap variations in the supplying/collecting spatial regions 88*a* and 88*b* may be generated, as described above. However, in the developing device 34 according to the embodiment, a current flowing in the first power source 120 is detected. On the basis of the detected current flowing in the first power source 120, the operations of the first, second and third power sources 120, 130 and 140, which form predetermined electric fields between the transporting roller 54 and the developing rollers 48*a* and 48*b*, are controlled. Specifically, on the basis of the detected current flowing in the first electrochemical device 120, the load capacities of the spatial regions 88*a* and 88*b* formed between the transporting roller 54 and the developing rollers 48*a* and 48*b*, respectively, are calculated. On the basis of the calculated load capacities of the spatial regions 88*a* and 88*b*, the operations of the first, second and third power sources 120, 130 and 140 are controlled. In this way, the above-mentioned problem is avoided.

The following will describe a method for detecting the current flowing in the first power source 120, a method for calculating the load capacities of the spatial regions 88*a* and 88*b* formed between the transporting roller 54 and the developing rollers 48*a* and 48*b*, respectively, and the control of the operations of the first, second and third power sources 120, 130 and 140 in the developing device 34 according to the embodiment.

As illustrated in FIG. 2, in the image forming apparatus 1, the photoreceptor 12 is connected to the ground 116. In the developing device 34, the transporting roller 54 is connected to the ground 116 through the first power source 120 composed of the first DC power source 121 and the first AC power source 122. The first developing roller 48*a* is connected to the ground 116 through the second power source 130 composed of the second DC power source 131 and the second AC power source 132. The second developing roller 48*b* is connected to the ground 116 through the third power source 140 composed of the third DC power source 141 and the third AC power source 142.

As illustrated in FIG. 4, the equivalent circuit of the circuit composed of the transporting roller 54 and the developing rollers 48*a* and 48*b* is represented as the following circuit: a circuit in which the first power source 120, the first capacitor C1 and the second power source 130 are connected in series to each other, the first capacitor C1 being composed of the transporting roller 54 and the first developing roller 48*a* opposite to each other to interpose the first supplying/collecting gap 56*a* therebetween, and further, the first power source 120, the second capacitor C2 and the third power source 140 are connected in series to each other, the second capacitor C2 being composed of the transporting roller 54 and the second developing roller 48*b* opposite to each other to interpose the second supplying/collecting gap 56*b* therebetween.

Firstly, the method for detecting the current flowing in the first power source 120 is described below.

Figure 5:
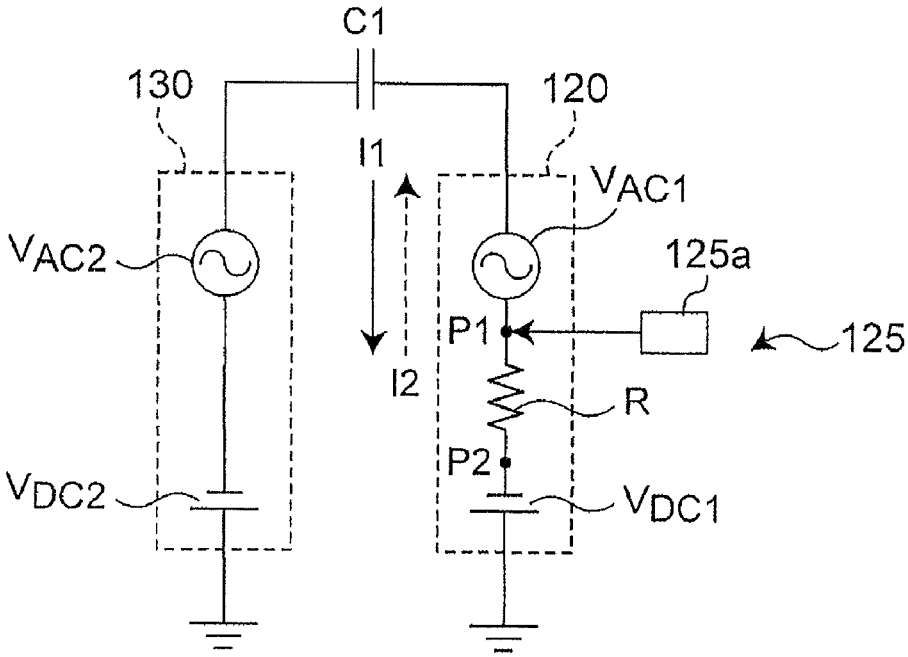
FIG. 5 is a diagram referred to in order to describe a method for detecting a current flowing in a first power source by means of a detecting block.
Figure 6:
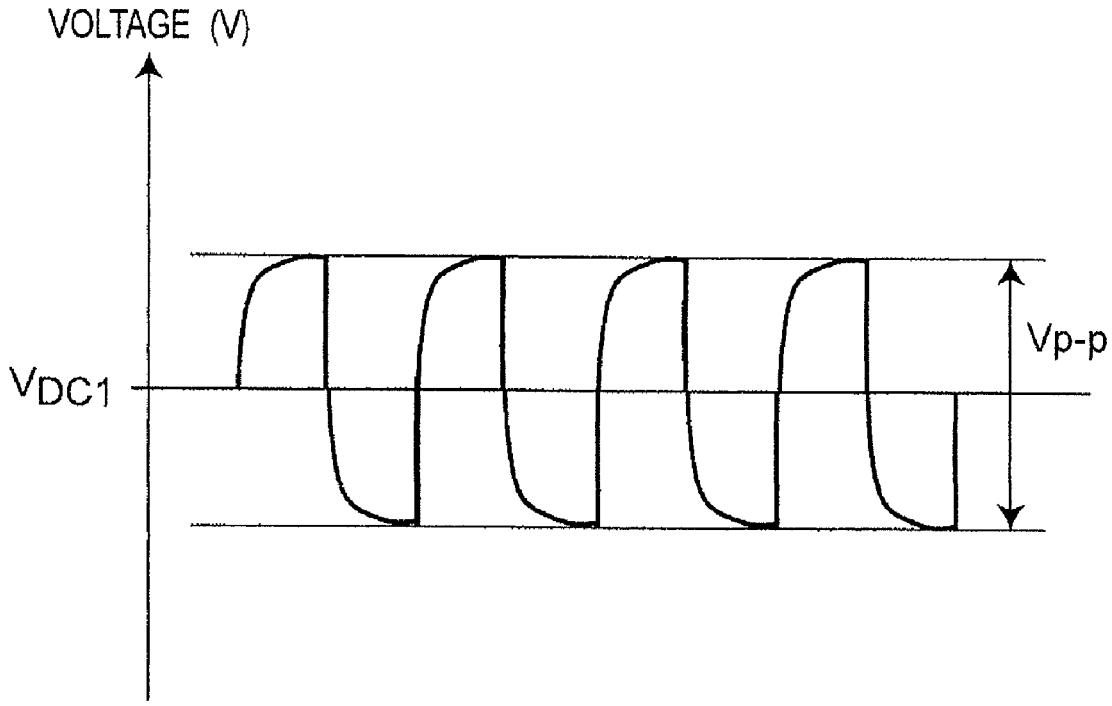
FIG. 6 is a graph showing detected values of a monitor voltage of the detecting block.

FIG. 5 is a diagram for describing the method for detecting the current flowing in the first power source by means of the detecting block. In FIG. 5 is shown a circuit composed of the first power source 120, the first capacitor C1 and the second power source 130 illustrated in FIG. 4. FIG. 6 is a graph showing detected values of the monitor voltage of the detecting block. FIG. 6 shows the detected values of the monitor voltage of the detecting block 125 for detecting the current flowing in the first power source 120.

As illustrated in FIG. 5, the detecting block 125 has, inside the first power source 120, a resistance R1 between the first DC power source 121 and the first AC power source 122 so as to be connected in series to the first DC power source 121 and the first AC power source 122, and also has a monitor voltage 125*a* through which the voltage at a predetermined position P1 between the resistance R1 and the first AC power source 122 is detected. From the voltage detected through the monitor voltage 125*a*, the current flowing in the first power source 120 can be detected.

Specifically, in the circuit illustrated in FIG. 5, the voltage detected through the monitor voltage 125*a*, that is, the voltage detected at the position P1 is represented as a voltage waveform having an amplitude $V_{P\text{-}P}$ relative to the center of the voltage $V_{DC1}$ at a position P2 as illustrated in FIG. 6. When a current I1 flows in a direction represented by a solid line arrow in FIG. 5, the following is detected as the monitor voltage 125*a*: a voltage represented by $[V_{DC1}+(R1\times I1)]$, which is higher than the voltage $V_{DC1}$ at the position P2. When a current I2 flows in a direction represented by a broken line arrow in FIG. 5, the following is detected as the monitor voltage 125*a*: a voltage represented by $[V_{DC1}-(R1\times I2)]$, which is lower than the voltage $V_{DC1}$ at the position P2. The current flowing in the first power source 120 can be detected from the voltage detected through the monitor voltage 125*a* and the resistance R. In this way, the detecting block 125 can detect the current flowing in the first power source 120 from the voltage detected through the monitor voltage 125*a*. The circuit composed of the first power source 120, the first capacitor C1 and the second power source 130 is described in FIG. 5; however, the detecting block 125 can detect the current flowing in the first power source 120 from the voltage detected through the monitor voltage 125*a* also in the circuit shown in FIG. 4.

Secondly, the method for calculating the load capacities of the spatial regions 88*a* and 88*b* formed between the transporting roller 54 and the developing rollers 48*a* and 48*b*, respectively, are described.

In order to calculate the load capacities of the spatial regions 88*a* and 88*b* formed between the transporting roller 54 and the developing rollers 48*a* and 48*b*, respectively, on the basis of the current detected by the detecting block 125, the voltage between the front and the rear of the resistance R in the detecting block 125 has been detected from this current and the resistance R in the detecting block 125, and then the following has been examined: a relationship between the load capacities of the supplying/collecting spatial regions 88*a* and 88*b* formed between the transporting roller 54 and the developing rollers 48*a* and 48*b*, respectively, and the amplitude of the voltage between the front and the rear of the resistance R in the detecting block 125.

In the embodiment, the amplitude of the voltage between the front and the rear of the resistance R in the detecting block 125 is equal to the amplitude of the voltage detected through the monitor voltage 125*a*; therefore, the following has been examined: a relationship between the load capacities of the supplying/collecting spatial regions 88*a* and 88*b* and the amplitude of the voltage detected through the monitor voltage 125*a* of the detecting block 125.

Specifically, as illustrated in FIG. 5, the capacitor C1, which imitates the supplying/collecting spatial region 88*a* having a predetermined load capacity, has been connected between the first and second power sources 120 and 130, predetermined voltages have been applied to the first and second power sources 120 and 130, respectively to generate a predetermined voltage between both ends of the capacitor C1, and then the following has been examined: the relationship between the load capacity of the capacitor C1 and the amplitude $V_{P\text{-}P}$ of the monitor voltage of the detecting block 125. The relationship between the load capacity of the capacitor C2, which imitates the supplying/collecting spatial region 88*b* and the amplitude $V_{P\text{-}P}$ of the monitor voltage of the detecting block 125 is also identical to the relationship between the load capacity of the capacitor C1 and the amplitude $V_{P\text{-}P}$ of the monitor voltage of the detecting block 125.

Capacitors having load capacities of 50 pF, 100 pF and 200 pF, respectively, have each been used as the capacitor C1. Regarding each of the capacitors, the first and second power sources 120 and 130 have been operated to set the amplitude $V_{P\text{-}P}$ of the voltage applied to between both the ends of the capacitor C1 to 1400 V, 1700 V, 2000 V and 2300 V, respectively. In this manner, the above-mentioned relationship has been examined.

When the amplitude $V_{P\text{-}P}$ of the voltage applied to between both the ends of the capacitor C1 is 1400 V, 1700 V, 2000 V and 2300 V, respectively, in the case of using, as the capacitor C1, each of the capacitors having the load capacities of 50 pF, 100 pF and 200 pF, respectively, values of the amplitude $V_{P\text{-}P}$ of the voltage detected through the monitor voltage 125*a* of the detecting block 125 are shown in Table 1 below.

TABLE 1

| | Amplitude of voltage applied to between both ends of capacitor | | | |
|---|---|---|---|---|
| | 1400 V | 1700 V | 2000 V | 2300 V |
| Capacitor load capacity: 50 pF | 15 V | 20 V | 25 V | 30 V |
| Capacitor load capacity: 100 pF | 30 V | 40 V | 50 V | 60 V |
| Capacitor load capacity: 200 pF | 60 V | 80 V | 100 V | 120 V |

As shown in Table 1, when the amplitude $V_{P\text{-}P}$ of the voltage applied to between both the ends of the capacitor C1 is 1400 V and the load capacity of the capacitor C1 is 50 pF, the amplitude $V_{P\text{-}P}$ of the monitor voltage is 15 V. When the amplitude $V_{P\text{-}P}$ of the voltage applied to between both the ends of the capacitor C1 is 1400 V and the load capacity of the capacitor C1 is 100 pF and 200 pF, respectively, the amplitude $V_{P\text{-}P}$ of the monitor voltage is 30 V and 60 V, respectively.

When the amplitude $V_{P\text{-}P}$ of the voltage applied to between both the ends of the capacitor C1 is 1700 V and the load capacity of the capacitor C1 is 50 pF, 100 pF and 200 pF, respectively, the amplitude $V_{P\text{-}P}$ of the monitor voltage is 20 V, 40 V and 80 V, respectively. When the amplitude $V_{P\text{-}P}$ of the voltage applied to between both the ends of the capacitor C1 is 2000 V and the load capacity of the capacitor C1 is 50 pF, 100 pF and 200 pF, respectively, the amplitude $V_{P\text{-}P}$ of the monitor voltage is 25 V, 50 V and 100 V, respectively. When the amplitude $V_{P-P}$ of the voltage applied to between both the ends of the capacitor C1 is 2300 V and the load capacity of the capacitor C1 is 50 pF, 100 pF and 200 pF, respectively, the amplitude $V_{P-P}$ of the monitor voltage is 30 V, 60 V and 120 V, respectively.

Figure 7:
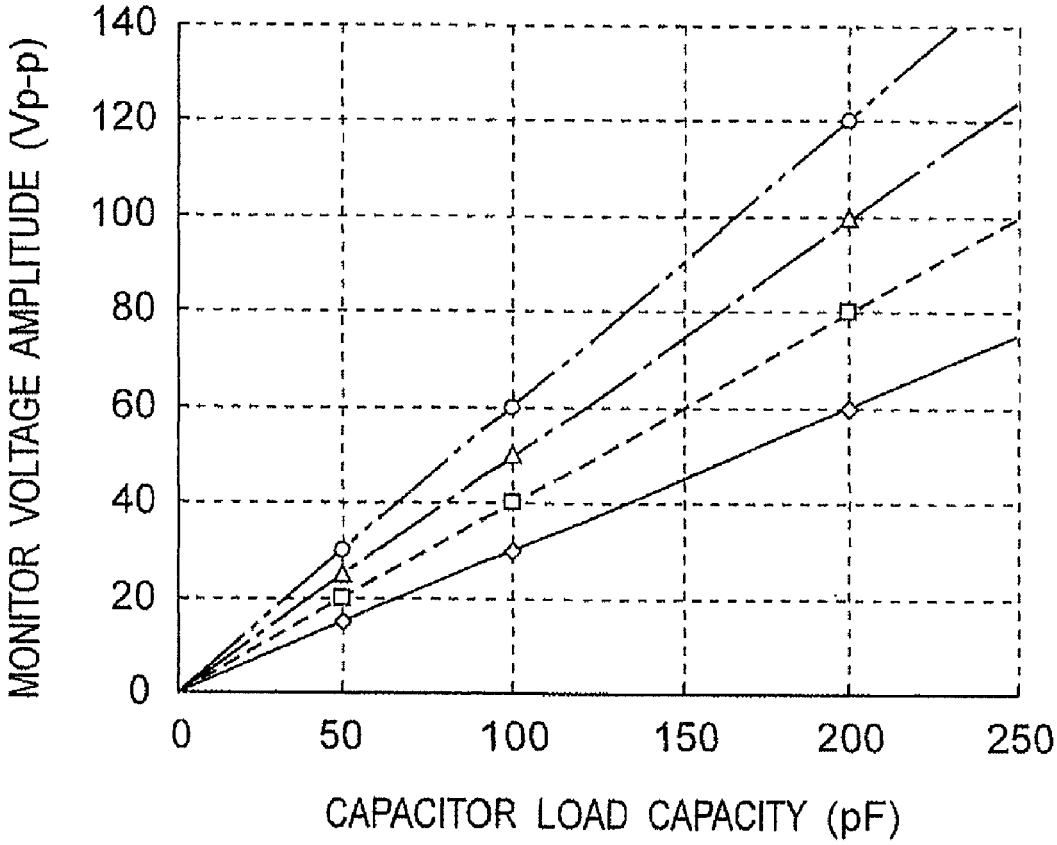
FIG. 7 is a graph showing a relationship between load capacities of a capacitor and amplitudes of the monitor voltage.

FIG. 7 is a graph showing the relationship between the load capacity of the capacitor C1 and the amplitude $V_{P-P}$ of the monitor voltage, and shows the relationship between the load capacity of the capacitor C1 and the amplitude $V_{P-P}$ of the monitor voltage in the case where the amplitude $V_{P-P}$ of the voltage applied to between both the ends of the capacitor C1 is 1400 V, 1700 V, 2000 V and 2300 V, respectively. In FIG. 7, the transverse axis of the graph represents the load capacity of the capacitor C1, and the vertical axis thereof represents the amplitude $V_{P-P}$ of the monitor voltage. In FIG. 7, the cases where the amplitude $V_{P-P}$ of the voltage applied to between both the ends of the capacitor C1 is 1400 V, 1700 V, 2000 V and 2300 V are represented by ◇, □, Δ and o, respectively.

When the load capacity of the capacitor C1 is 50 pF, 100 pF, and 200 pF, respectively, in the case where the amplitude $V_{P-P}$ of the voltage applied to between both the ends of the capacitor C1 is 1400 V, the amplitude $V_{P-P}$ of the monitor voltage is 15 V, 30 V and 60 V, respectively. The load capacity of the capacitor C1 and the amplitude $V_{P-P}$ of the monitor voltage have a proportional relationship. As represented by a solid line in FIG. 7, the amplitude $V_{P-P}$ of the monitor voltage becomes larger as the load capacity of the capacitor C1 becomes larger. It is understood that the relationship between the load capacity of the capacitor C1 and the amplitude $V_{P-P}$ of the voltage detected through the monitor voltage 125*a* is represented by the following relational expression (1):

(the amplitude of the voltage detected through the monitor voltage)=(the load capacity of the capacitor)×0.3 (1)

When the amplitude $V_{P-P}$ of the voltage applied to between both the ends of the capacitor C1 is 1700 V, 2000 V and 2300 V, respectively, also, the load capacity of the capacitor C1 and the amplitude $V_{P-P}$ of the monitor voltage have a proportional relationship. As represented by a broken line, an alternate long and short dash line, and an alternate long and two short dash line, respectively in FIG. 7, the amplitude $V_{P-P}$ of the monitor voltage becomes larger as the load capacity of the capacitor C1 becomes larger. It is understood that, when the amplitude $V_{P-P}$ of the voltage applied to between both the ends of the capacitor C1 is 1700 V, the relationship between the load capacity of the capacitor C1 and the amplitude $V_{P-P}$ of the voltage detected through the monitor voltage 125*a* is represented by the following relational expression (2):

(the amplitude of the voltage detected through the monitor voltage)=(the load capacity of the capacitor)×0.4 (2), when the amplitude $V_{P-P}$ of the voltage applied to between both the ends of the capacitor C1 is 2000 V, the relationship is represented by the following relational expression (3):

(the amplitude of the voltage detected through the monitor voltage)=(the load capacity of the capacitor)×0.5 (3), and when the amplitude $V_{P-P}$ of the voltage applied to between both the ends of the capacitor C1 is 2300 V, the relationship is represented by the following relational expression (4):

(the amplitude of the voltage detected through the monitor voltage)=(the load capacity of the capacitor)×0.6 (4)

From these results, it is understood that, about the circuit composed of the transporting roller 54 and the developing rollers 48*a* and 48*b*, which is represented by the equivalent circuit illustrated in FIG. 4, the relationship between the load capacities of the capacitors C1 and C2 and the amplitude $V_{P-P}$, of the monitor voltage is represented by the relational expressions (1) to (4) in accordance with the amplitude $V_{P-P}$ of the monitor voltage. The capacitors C1 and C2 imitate the supplying/collecting spatial regions 88*a* and 88*b*, respectively, and it is understood that, when each of the amplitudes $V_{P-P}$ of the voltages applied to the regions 88*a* and 88*b* is 1400 V, 1700 V, 2000 V and 2300 V, respectively, the relationship between the load capacities of the supplying/collecting spatial regions 88*a* and 88*b* and the amplitude $V_{P-P}$ of the monitor voltage is represented by the relational expressions (1) to (4), respectively.

Accordingly, in the developing device 34, for example, at the time of forming no image, the current flowing in the first power source 120 is detected by means of the detecting block 125 by applying predetermined voltages to the transporting roller 54 and the developing rollers 48*a* and 48*b*, respectively, so as to form, in the supplying/collecting spatial regions 88*a* and 88*b*, predetermined electric fields in which the amplitudes of the voltages applied to the regions 88*a* and 88*b* are each set to any one of 1400 V, 1700 V, 2000 V and 2300 V. Moreover, the current flowing in the first power source 120 is detected by means of the detecting block 125 by applying predetermined voltages to the transporting roller 54 and the developing rollers 48*a* and 48*b*, respectively, so as to form, in the regions 88*a* and 88*b*, predetermined electric fields in which the amplitudes $V_{P-P}$ of the voltages applied to the regions 88*a* and 88*b* are each set to any one of 1400 V, 1700 V, 2000 V and 2300 V, the predetermined electric fields being different from the above-mentioned predetermined electric fields. Furthermore, on the basis of each of the currents flowing in the first power source 120 detected by the detecting block 125, the voltage between the front and rear of the resistance R in the detecting block 125 is detected. On the basis of a relationship between the load capacities of the regions 88*a* and 88*b* corresponding to the amplitudes $V_{P-P}$ of the voltages applied to between both the ends of the region 88*a* and 88*b*, and the amplitude of the voltage between the front and rear of the resistance R in the detecting block 125 (in particular, a relationship between the load capacities of the supplying/collecting spatial regions 88*a* and 88*b* corresponding to the amplitudes $V_{P-P}$ of the voltages applied to between both the ends of the region 88*a* and 88*b*, and the amplitude $V_{P-P}$ of the monitor voltage in the embodiment), the load capacity of each of the regions 88*a* and 88*b* can be calculated.

The calculation of the load capacities of the supplying/collecting spatial regions 88*a* and 88*b* is specifically described.

For example, when no image is formed, the operations of the first, second and third power sources 120, 130 and 140 are controlled to set the amplitude $V_{P-P}$ of the voltage applied to between both the ends of the supplying/collecting spatial region 88*a* to 1400 V and set the amplitude $V_{P-P}$ of the voltage applied to between both the ends of the supplying/collecting spatial region 88*b* to 2300 V. At this time, the amplitude of the monitor voltage is detected by the detecting block 125. When the detected amplitude $V_{P-P}$ of the monitor voltage is 60 V, the following relational expression (5) is satisfied on the basis of the relational expressions (1) and (4) described above:

60=(the load capacity of the supplying/collecting spatial region 88*a*)×0.3+(the load capacity of the supplying/collecting spatial region 88*b*)×0.6 (5)

Next, the operations of the first, second and third power sources 120, 130 and 140 are controlled to set the amplitude $V_{P-P}$ of the voltage applied to between both the ends of the supplying/collecting spatial region 88*a* to 1700 V and set the amplitude $V_{P-P}$ of the voltage applied to between both the ends of the supplying/collecting spatial region 88*b* to 2000 V. At this time, the amplitude of the monitor voltage is detected by the detecting block 125. When the detected amplitude $V_{P-P}$ of the monitor voltage is 70 V, the following relational expression (6) is satisfied on the basis of the relational expressions (2) and (3):

70=(the load capacity of the supplying/collecting spatial region 88*a*)×0.4+(the load capacity of the supplying/collecting spatial region 88*b*)×0.5 (6)

Accordingly, from these two relational expressions (5) and (6), it is calculated that the load capacities of the supplying/collecting spatial regions 88*a* and 88*b* are 133 pF and 33 pF, respectively. The reason why the relational expressions (5) and (6) are satisfied is that the detected monitor voltage is equal to the monitor voltage of the summation of the current flowing in the capacitor C1 and that flowing in the second capacitor C2.

By calculating in advance the relationships between the load capacities of the supplying/collecting spatial regions 88*a* and 88*b* corresponding to the amplitudes $V_{P-P}$ of the voltages applied to between both the ends of the regions 88*b* and 88*b*, respectively, and the amplitude $V_{P-P}$ of the monitor voltage the voltage between the front and the rear of the resistance R in the detecting block 125 is detected on the basis of the current flowing in the first power source 120 detected by the detecting block 125 when predetermined electric fields are formed in the regions 88*a* and 88*b*, respectively, and the current flowing in the first power source 120 detected by the detecting block 125 when predetermined electric fields different from the above-mentioned predetermined electric fields are formed in the regions 88*a* and 88*b*, respectively. On the basis of the amplitude $V_{P-P}$ of the detected voltage between the front and the rear of the resistance R in the detecting block 125 (on the basis of the detected amplitude of the monitor voltage in the embodiment), the load capacities of the supplying/collecting spatial regions 88*a* and 88*b* can each be calculated from the relationship between the load capacities of the regions 88*a* and 88*b* corresponding to the amplitudes $V_{P-P}$ of the voltages applied to between both the ends of the regions 88*a* and 88*b*, and the amplitude $V_{P-P}$ of the monitor voltage.

In the control unit 21 are beforehand memorized the relationships between the load capacities of the supplying/collecting spatial regions 88*a* and 88*b* corresponding to the amplitudes $V_{P-P}$ of the voltages applied to between both the ends of the regions 88*a* and 88*b*, and the amplitude $V_{P-P}$ of the monitor voltage. When no image is formed, for example, every time after a predetermined number of sheets are subjected to image-forming steps, the control unit 21 controls, in the electric field controlling unit 21*a*, the operations of the first, second and third power sources 120, 130 and 140 so as to form predetermined electric fields in the supplying/collecting spatial regions 88*a* and 88*b* and further form predetermined electric fields different from the above-mentioned predetermined electric fields in the regions 88*a* and 88*b*. The control units 21 calculates, in the load capacity calculating unit 21*b*, the load capacities of the supplying/collecting spatial regions 88*a* and 88*b*, respectively, on the basis of the amplitude $V_{P-P}$ of the voltage detected through the monitor voltage 125*a* of the detecting block 125 when the predetermined electric fields are formed in the regions 88*a* and 88*b*, and the amplitude $V_{P-P}$ of the voltage detected through the monitor voltage 125*a* of the detecting block 125 when the predetermined electric fields different from the above-mentioned predetermined electric fields are formed in the regions 88*a* and 88*b*.

When an image is formed, the control unit 21 also controls, in the electric field controlling unit 21*a*, the operations of the first, second and third power sources 120, 130 and 140 to set the load capacities of the supplying/collecting spatial regions 88*a* and 88*b* into predetermined values, respectively. For example, when no image is formed, the control unit 21 calculates the load capacities of the regions 88*a* and 88*b* on the basis of the amplitude $V_{P-P}$ of the voltage detected through the monitor voltage 125*a* of the detecting block 12. The electric field controlling unit 21*a* then judges whether or not the load capacities of the regions 88*a* and 88*b* are in given ranges set beforehand relative to the predetermined values. When the load capacities of the regions 88*a* and 88*b* are judged not to be within the given ranges set beforehand, the operations of the first, second and third power sources 120, 130 and 140 can be caused to undergo feedback control.

In a case where it is judged that the load capacities of the supplying/collecting spatial regions 88*a* and 88*b* are not within the given ranges set beforehand relative to the predetermined values, the control unit 21 controls the first, second and third power sources 120, 130 and 140 to make small the amplitudes $V_{P-P}$ of the voltages applied to the regions 88*a* and 88*b* for forming the predetermined electric fields between the transporting roller 54 and the developing rollers 48*a* and 48*b*, respectively, when the control unit 21 judges that the load capacities of the regions 88*a* and 88*b* are larger than the predetermined values. In this way, in the developing device 34, the load capacities of the regions 88*a* and 88*b* may become larger upward from the given ranges relative to the predetermined values set beforehand, so that the supplying/collecting gaps 56*a* and 56*b* of the regions 88*a* and 88*b* may become small. In the case where the gaps 56 and 56*b* become small, the generation of a leakage can be restrained between the transporting roller 54 and the developing rollers 48*a* and 48*b*.

On the other hand, in a case where it is judged that the load capacities of the supplying/collecting spatial regions 88*a* and 88*b* are not within the given ranges set beforehand relative to the predetermined values, the control unit 21 controls the first, second and third power sources 120, 130 and 140 to make large the amplitudes $V_{P-P}$ of the voltages applied to the regions 88*a* and 88*b* for forming the predetermined electric fields between the transporting roller 54 and the developing rollers 48*a* and 48*b*, respectively, when the control unit 21 judges that the load capacities of the regions 88*a* and 88*b* are smaller than the predetermined values. In this way, in the developing device 34, the load capacities of the regions 88*a* and 88*b* may become larger downward from the given ranges relative to the predetermined values set beforehand, so that the supplying/collecting gaps 56*a* and 56*b* of the regions 88*a* and 88*b* may become large. In the case where the gaps 56 and 56*b* become large, the toner-collecting performance of shifting the toner from the transporting roller 54 to the developing rollers 48*a* and 48*b* can be improved, so that the generation of an image memory can be restrained.

As described above, in a case where, in the developing device 34 according to the embodiment, the load capacities of the supplying/collecting spatial regions 88*a* and 88*b* are not within the given ranges relative to the predetermined values set beforehand, the operations of the first, second and third power sources 120, 130 and 140 are caused to undergo feedback control. Thus, even when variations are caused in the lengths of the supplying/collecting gaps 56*a* and 56*b* of the supplying/collecting spatial regions 88*a* and 88*b* formed between the transporting roller 54 and the developing rollers 48*a* and 48*b*, respectively, it is possible to restrain the generation of an image memory or leakage caused by the gap length variations between the transporting roller 54 and the developing rollers 48*a* and 49*b*. As a result, a stable development can be attained.

As described above, in the embodiment, the operations of the first, second third power sources 120, 130 and 140 for forming predetermined electric fields between the transporting roller 54 and the developing rollers 48*a* and 49*b* are controlled on the basis of the current flowing in the first power source 120 detected by the detecting block 125. In this way, from the current flowing in the first power source 120, length variations are detected in the gaps 56*a* and 56*b* of the regions 88*a* and 88*b* formed between the transporting roller 54 and the developing rollers 48*a* and 48*b*. The detection of the gap length variations in the gaps 56*a* and 56*b* makes it possible to control the operations of the first, second third power sources 120, 130 and 140, which form predetermined electric fields between the transporting roller 54 and the developing rollers 48*a* and 48*b*, on the basis of the gap length variations. Thus, an image memory or leakage caused by the gap length variation can be restrained so that a stable development can be attained.

Specifically, the operations of the first, second and third power sources 120, 130 and 140 are controlled on the basis of the current flowing in the first power source 120 detected when predetermined electric fields are formed in the supplying/collecting spatial regions 88*a* and 88*b*, respectively, and the current flowing in the first power source 120 detected when predetermined electric fields different from the above-mentioned predetermined electric fields are formed in the regions 88*a* and 88*b*, respectively. According to this manner, a length variation in each of the gaps 56*a* and 56*b* of the supplying/collecting spatial regions 88*a* and 88*b* is detected from the current flowing in the first power source 120. The detection of the length variations in the gaps 56*a* and 56*b* makes it possible to control the operations of the first, second and third power sources 120 130 and 140 on the basis of the gap length variations. Thus, it is possible to restrain the generation of an image memory or leakage caused by the gap length variations in the regions 88*a* and 88*b*. As a result, a stable development can be attained.

In the embodiment, the following case has been given as an example: the case in which the vibration voltage $V_{DC1}+V_{AC1}$ obtained by superimposing the alternating voltage $V_{AC1}$ onto the direct voltage $V_{DC1}$ is applied from the power source 120 to the transporting roller 54, and the vibration voltages $V_{DC2}+V_{AC2}$ and $V_{DC3}+V_{AC3}$, which are obtained by superimposing the alternating voltages $V_{AC2}$ and $V_{AC3}$ onto the direct voltages $V_{DC2}$ and $V_{DC3}$, respectively, are applied from the power sources 130 and 140 to the developing rollers 48*a* and 48*b*, respectively. However, the case allowable in the invention is not limited to this case. When it is possible to supply the toner 6 from the transporting roller 54 to the developing rollers 48*a* and 48*b* in the supplying/collecting spatial regions 88*a* and 88*b*, make a development and subsequently collect a fraction of the toner 6 that remains on the developing rollers 48*a* and 48*b* onto the transporting roller 54, the following case is allowable: a case in which any one of a direct voltage and a vibration voltage is applied from the power source 120 to the transporting roller 54 and vibration voltages are applied from the power sources 130 and 140 to the developing rollers 48*a* and 48*b*. In this case also, where any one of a direct voltage and a vibration voltage is applied to the transporting roller 54, an image memory or leakage caused by the gap length variations in the supplying/collecting spatial regions 88*a* and 88*b* can be restrained by calculating the load capacities of the regions 88*a* and 88*b* on the basis of the current flowing in the first power source 120, and then controlling the operations of the power sources 120, 130 and 140 on the basis of the calculated load capacities of the regions 88*a* and 88*b*. Thus, a stable development can be attained.

As described above, the invention is not limited to the embodiments given as examples. It is needless to say that the embodiments may be modified into various forms or changed in design as far as the modified or changed embodiments do not depart from the subject matter of the invention.

What is claimed is:

1. A developing device, comprising:

a developer transporting member that is rotatably driven, and transports a developer containing a toner and a carrier while the member holds, on an outer circumferential surface thereof, the developer, a toner transporting member that is rotatably driven, and is opposite to the developer transporting member and opposite to an electrostatic latent image carrying member so as to transport the toner, a first electric field forming device that includes a power source for the developer transporting member connected to the developer transporting member, and a power source for the toner transporting member connected to the toner transporting member, forms a predetermined electric field between the developer transporting member and the toner transporting member, and shifts the toner in the developer held onto the developer transporting member to the toner transporting member, and a second electric field forming device that includes the toner transporting member power source connected to the toner transporting member, forms a predetermined electric field between the toner transporting member and the electrostatic latent image carrying member, and shifts the toner held onto the toner transporting member onto an electrostatic latent image on the electrostatic latent image carrying member, the developer being used to develop the electrostatic latent image on the electrostatic latent image carrying member, and after the development a fraction of the toner which remains on the toner transporting member being collected to the developer transporting member, the developing device further comprising:

a detecting block that detects a current flowing in the developer transporting member power source, and an electric field controlling device that controls operation of the first electric field forming device based on the current flowing in the developer transporting member power source, the current being detected by the detecting block.

2. The developing device according to claim 1, further comprising a load capacity calculating device that calculates a load capacity of a spatial region formed between the developer transporting member and the toner transporting member based on the current flowing in the developer transporting member power source, the current being detected by the detecting block, wherein the electric field controlling device controls operation of the first electric field forming device based on the load capacity of the spatial region formed between the developer transporting member and the toner transporting member, which is calculated by the load capacity calculating device.

3. A developing device, comprising:

a developer transporting member that is rotatably driven, and transports a developer containing a toner and a carrier while the member holds, on an outer circumferential surface thereof, the developer, a first toner transporting member that is rotatably driven, and is opposite to the developer transporting member to interpose a first spatial region between the first toner transporting member and the developer transporting member and opposite to an electrostatic latent image carrying member to interpose a second spatial region between the first toner transporting member and the carrying member, so as to transport the toner, a second toner transporting member that is rotatably driven, and is opposite to the developer transporting member to interpose a third spatial region between the second toner transporting member and the developer transporting member and opposite to the electrostatic latent image carrying member to interpose a fourth spatial region between the second toner transporting member and the carrying member, so as to transport the toner, a first electric field forming device that includes a power source for the developer transporting member connected to the developer transporting member, and a power source for the first toner transporting member connected to the first toner transporting member, forms a first electric field between the developer transporting member and the first toner transporting member, and shifts the toner in the developer held onto the developer transporting member to the first toner transporting member, a second electric field forming device that includes the first toner transporting member power source connected to the first toner transporting member, forms a second electric field between the first toner transporting member and the electrostatic latent image carrying member, and shifts the toner held onto the first toner transporting member to an electrostatic latent image on the electrostatic latent image carrying member, a third electric field forming device that includes the developer transporting member power source connected to the developer transporting member and a power source for the second toner transporting member connected to the second toner transporting member, forms a third electric field between the developer transporting member and the second toner transporting member, and shifts the toner in the developer held onto the developer transporting member to the second toner transporting member, and a fourth electric field forming device that includes the second toner transporting member power source connected to the second toner transporting member, forms a fourth electric field between the second toner transporting member and the electrostatic latent image carrying member, and shifts the toner held onto the second toner transporting member to the electrostatic latent image on the electrostatic latent image carrying member, the developer being used to develop the electrostatic latent image on the electrostatic latent image carrying member, and after the development fractions of the toner which remain on the first and second toner transporting members, respectively, are collected to the developer transporting member, the developing device further comprising:

a detecting block that detects a current flowing in the developer transporting member power source, and an electric field controlling device that controls each of operation of the first electric field forming device and that of the third electric field forming device based on a current flowing in the developer transporting member power source, the current being detected by the detecting block in a case of forming predetermined electric fields in the first and third spatial regions by the first and third electric field forming devices, respectively, and a current flowing in the developer transporting member power source, the current being detected by the detecting block in a case of forming predetermined electric fields different from the predetermined electric fields in the first and third spatial regions by the first and third electric field forming devices, respectively.

4. The developing device according to claim 3, further comprising a load capacity calculating device that calculates a load capacity of each of the first and third spatial regions based on the current flowing in the developer transporting member power source detected by the detecting block in the case of forming the predetermined electric fields in the first and third spatial regions, respectively, and the current flowing in the developer transporting member power source detected by the detecting block in the case of forming the predetermined electric fields different from the predetermined electric fields in the first and third spatial regions, respectively, wherein the electric field controlling device controls each of operation of the first electric field forming device and that of the third electric field forming device based on the load capacities of the first and third spatial regions, the load capacities being calculated by the load capacity calculating device.

5. A method for controlling a developing device including:

a developer transporting member that is rotatably driven and transports a developer containing a toner and a carrier while the member holds on an outer circumferential surface thereof the developer, a toner transporting member that is rotatably driven and is opposite to the developer transporting member and opposite to an electrostatic latent image carrying member so as to transport the toner, a first electric field forming device that includes a power source for the developer transporting member connected to the developer transporting member and a power source for the toner transporting member connected to the toner transporting member, forms a predetermined electric field between the developer transporting member and the toner transporting member, and shifts the toner in the developer held onto the developer transporting member to the toner transporting member, and a second electric field forming device that includes the toner transporting member power source connected to the toner transporting member, forms a predetermined electric field between the toner transporting member and the electrostatic latent image carrying member, and shifts the toner held onto the toner transporting member to an electrostatic latent image on the electrostatic latent image carrying member, the developer being used to develop the electrostatic latent image on the electrostatic latent image carrying member, and after the development a fraction of the toner which remains on the toner transporting member being collected to the developer transporting member, the method comprising the step of detecting a current flowing in the developer transporting member power source, and then controlling operation of the first electric field forming device based on the detected current flowing in the developer transporting member power source.

6. The developing device controlling method according to claim 5, wherein based on the detected current flowing in the developer transporting member power source, a load capacity of a spatial region formed between the developer transporting member and the toner transporting member is calculated, and based on the calculated load capacity of the spatial region, operation of the first electric field forming device is controlled.

7. A method for controlling a developing device including:

a developer transporting member that is rotatably driven and transports a developer containing a toner and a carrier while the member holds on an outer circumferential surface thereof the developer, a first toner transporting member that is rotatably driven and is opposite to the developer transporting member to interpose a first spatial region between the first toner transporting member and the developer transporting member and opposite to an electrostatic latent image carrying member to interpose a second spatial region between the first toner transporting member and the carrying member, so as to transport the toner, a second toner transporting member that is rotatably driven and is opposite to the developer transporting member to interpose a third spatial region between the second toner transporting member and the developer transporting member and opposite to the electrostatic latent image carrying member to interpose a fourth spatial region between the second toner transporting member and the carrying member, so as to transport the toner, a first electric field forming device that includes a power source for the developer transporting member connected to the developer transporting member and a power source for the first toner transporting member connected to the first toner transporting member, forms a first electric field between the developer transporting member and the first toner transporting member, and shifts the toner in the developer held onto the developer transporting member to the first toner transporting member, a second electric field forming device that includes the first toner transporting member power source connected to the first toner transporting member, forms a second electric field between the first toner transporting member and the electrostatic latent image carrying member, and shifts the toner held onto the first toner transporting member onto an electrostatic latent image on the electrostatic latent image carrying member, a third electric field forming device that includes the developer transporting member power source connected to the developer transporting member and a power source for the second toner transporting member connected to the second toner transporting member, forms a third electric field between the developer transporting member and the second toner transporting member, and shifts the toner in the developer held onto the developer transporting member to the second toner transporting member, and a fourth electric field forming device that includes the second toner transporting member power source connected to the second toner transporting member, forms a fourth electric field between the second toner transporting member and the electrostatic latent image carrying member, and shifts the toner held onto the second toner transporting member to the electrostatic latent image on the electrostatic latent image carrying member, the developer being used to develop the electrostatic latent image on the electrostatic latent image carrying member, and after the development fractions of the toner which remain on the first and second toner transporting members, respectively, being collected to the developer transporting member, the method comprising the step of detecting a current flowing in the developer transporting member power source in a case of forming predetermined electric fields in the first and third spatial regions by the first and third electric field forming devices, respectively, and a current flowing in the developer transporting member power source in a case of forming predetermined electric fields different from the predetermined electric fields in the first and third spatial regions by the first and third electric field forming devices, respectively, and then controlling each of operation of the first electric field forming device and that of the third electric field forming device based on the detected current flowing in the developer transporting member power source in the case of forming the predetermined electric fields in the first and third spatial regions, respectively, and the detected current flowing in the developer transporting member power source in the case of forming the predetermined electric fields different from the predetermined electric fields in the first and third spatial regions, respectively.

8. The developing device controlling method according to claim 7, wherein a load capacity of each of the first and third spatial regions is calculated based on the detected current flowing in the developer transporting member power source in the case of forming the predetermined electric fields in the first and third spatial regions, respectively, and the detected current flowing in the developer transporting member power source in the case of forming the predetermined electric fields different from the predetermined electric fields in the first and third spatial regions, respectively, and then each of operation of the first electric field forming device and that of the third electric field forming device is controlled based on the calculated load capacities of the first and third spatial regions.

* * * * *